US010924878B2

(12) United States Patent
Crum

(10) Patent No.: US 10,924,878 B2
(45) Date of Patent: Feb. 16, 2021

(54) AUGMENTED HEARING SYSTEM

(71) Applicant: Dolby Laboratories Licensing Corporation, San Francisco, CA (US)

(72) Inventor: Poppy Anne Carrie Crum, Oakland, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 1 day.

(21) Appl. No.: 16/539,929

(22) Filed: Aug. 13, 2019

(65) Prior Publication Data

US 2020/0045492 A1 Feb. 6, 2020

Related U.S. Application Data

(63) Continuation of application No. 15/569,071, filed as application No. PCT/US2016/028995 on Apr. 22, 2016, now Pat. No. 10,419,869.
(Continued)

(51) Int. Cl.
*H04S 7/00* (2006.01)
*H04R 5/033* (2006.01)
(Continued)

(52) U.S. Cl.
CPC ..... *H04S 7/304* (2013.01); *H04R 5/033* (2013.01); *H04S 3/008* (2013.01); *H04R 1/1083* (2013.01); *H04R 2201/107* (2013.01); *H04R 2460/07* (2013.01); *H04S 2400/11* (2013.01); *H04S 2400/15* (2013.01); *H04S 2420/11* (2013.01)

(58) Field of Classification Search
None
See application file for complete search history.

(56) References Cited

U.S. PATENT DOCUMENTS

2011/0164768 A1 7/2011 Huseth
2011/0257974 A1 10/2011 Kristjansson
(Continued)

FOREIGN PATENT DOCUMENTS

WO 02067007 8/2002

OTHER PUBLICATIONS

Guerrier, Stephane "Improving Accuracy with Multiple Sensors: Study of Redundant MEMS-IMU/GPS Configurations" Sep. 2009.
(Continued)

*Primary Examiner* — James K Mooney

(57) ABSTRACT

Some implementations may involve receiving, via an interface system, personnel location data indicating a location of at least one person and receiving, from an orientation system, headset orientation data corresponding with the orientation of a headset. First environmental element location data, indicating a location of at least a first environmental element, may be determined. Based at least in part on the headset orientation data, the personnel location data and the first environmental element location data, headset coordinate locations of at least one person and at least the first environmental element in a headset coordinate system corresponding with the orientation of the headset may be determined. An apparatus may be caused to provide spatialization indications of the headset coordinate locations. Providing the spatialization indications may involve controlling a speaker system to provide environmental element sonification corresponding with at least the first environmental element location data.

20 Claims, 16 Drawing Sheets

Related U.S. Application Data

(60) Provisional application No. 62/152,515, filed on Apr. 24, 2015.

(51) Int. Cl.
*H04S 3/00* (2006.01)
*H04R 1/10* (2006.01)

(56) References Cited

U.S. PATENT DOCUMENTS

| | | | |
|---|---|---|---|
| 2012/0207308 | A1 | 8/2012 | Sung |
| 2013/0041648 | A1 | 2/2013 | Osman |
| 2013/0217488 | A1 | 8/2013 | Comsa |
| 2013/0236040 | A1 | 9/2013 | Crawford |
| 2014/0219485 | A1 | 8/2014 | Jensen |
| 2014/0348365 | A1 | 11/2014 | Edwards |

OTHER PUBLICATIONS

Pulkki, Ville "Compensating Displacement of Amplitude-Panned Virtual Sources" Audio Engineering Society, 22nd International Conference, Synthetic and Entertainment Audio, pp. 186-195, Espoo, Finland, 2002.

Stubberud, P.A. "A Signal Processing Technique for Improving the Accuracy of MEMS Inertial Sensors" 19th International Conference on Systems Engineering, Aug. 19-21, 2008, pp. 13-18.

300b

AUGMENTED HEARING SYSTEM

CROSS-REFERENCE TO RELATED APPLICATION

An Application Data Sheet is filed concurrently with this specification as part of the present application. Each application that the present application claims benefit of or priority to as identified in the concurrently filed Application Data Sheet is incorporated by reference herein in its entirety and for all purposes.

TECHNICAL FIELD

This disclosure relates to audio apparatus for use in a battlefield context.

BACKGROUND

Current tactical headsets used by ground soldiers may provide some degree of hearing protection and combat communications. Audio content is perceptually represented at the location of the speaker and is generally limited to providing radio traffic and communication signals. Improved methods and apparatus would be desirable.

SUMMARY

At least some aspects of the present disclosure may be implemented via apparatus. For example, one or more devices may be capable of performing, at least in part, the methods disclosed herein. In some implementations, an apparatus may include an interface system, a headset and a control system. The headset may include a speaker system and an orientation system capable of determining an orientation of the headset. The orientation system may, for example, include at least one accelerometer, magnetometer and/or gyroscope.

The interface system may include a network interface, an interface between the control system and a memory system, an interface between the control system and another device and/or an external device interface. The control system may include at least one of a general purpose single- or multi-chip processor, a digital signal processor (DSP), an application specific integrated circuit (ASIC), a field programmable gate array (FPGA) or other programmable logic device, discrete gate or transistor logic, or discrete hardware components.

The control system may be capable of receiving, via the interface system, personnel location data indicating a location of at least one person. In some examples, the control system may be capable of receiving, from the orientation system, headset orientation data corresponding with the orientation of the headset. According to some examples, the control system may be capable of determining first environmental element location data indicating a location of at least a first environmental element. The control system may be capable of determining, based at least in part on the headset orientation data, the personnel location data and the first environmental element location data, headset coordinate locations of at least one person and at least the first environmental element in a headset coordinate system corresponding with the orientation of the headset. In some examples, the first environmental element may be a stationary environmental element.

In some examples, the control system may be capable of causing the apparatus to provide spatialization indications of the headset coordinate locations. According to some such examples, causing the apparatus to provide spatialization indications may involve controlling the speaker system to provide environmental element sonification corresponding with at least the first environmental element location data. In some implementations, causing the apparatus to provide spatialization indications may involve controlling the speaker system to provide personnel sonification corresponding with the personnel location data of at least one person.

In some implementations, the apparatus may include a display system. According to some such implementations, causing the apparatus to provide spatialization indications may involve controlling the display system to display a personnel location, an environmental element location, or both. According to some such implementations, the display system may include a display presented on eyewear. According to some such implementations, the control system may be capable of controlling the display system to provide a spatialization indication of a personnel location, an environmental element location, or both, on the eyewear.

In some examples, the apparatus may include a memory system. According to some such examples, determining the environmental element location data may involve retrieving the environmental element location data from the memory system.

In some implementations, the apparatus may include a microphone system. In some examples, the headset may include apparatus for adaptively attenuating environmental noise based, at least in part, on microphone data from the microphone system.

According to some implementations, the control system may be capable of determining, based at least in part on microphone data from the microphone system, second environmental element location data indicating a location of a second environmental element. According to some such implementations, the control system may be capable of determining, based at least in part on the headset orientation data and the second environmental element location data, a headset coordinate location of the second environmental element that is relative to the orientation of the headset. According to some such implementations, the control system may be capable of causing the apparatus to provide a spatialization indication of the headset coordinate location of the second environmental element.

In some examples, the second environmental element may be a moveable environmental element. According to some such examples, the control system may be capable of determining, based at least in part on microphone data from the microphone system, second environmental element trajectory data indicating a trajectory of a second environmental element. The control system may be capable of determining, based at least in part on the headset orientation data and the second environmental element trajectory data, a headset coordinate trajectory of the second environmental element that is relative to the orientation of the headset. The control system may be capable of causing the apparatus to provide a spatialization indication of the headset coordinate trajectory of the second environmental element. The spatialization indication may be audio and/or visual. For example, if the apparatus includes a display system, causing the apparatus to provide a spatialization indication may involve controlling the display system to display the spatialization indication of the headset coordinate location or the headset coordinate trajectory of the second environmental element.

In some examples, the apparatus may include one or more types of communication functionality. In some examples, the personnel location data may include geographically-tagged metadata included with communication data received from the at least one person. According to some such examples, the communication data may include radio communication data. In some implementations, the control system may be capable of receiving voice data via the microphone system, determining a current position of the apparatus and transmitting, via the interface system, a representation of the voice data and an indication of the current position of the apparatus.

In some implementations, the personnel location data may include coordinates in a cartographic coordinate system. According to some such implementations, the control system may be capable of transforming location data from a first coordinate system to the headset coordinate system. The first coordinate system may, for example, be a cartographic coordinate system.

In some examples, the control system may be capable of determining personalized hearing profile data, e.g., by retrieving a user's personalized hearing profile data from a memory system. According to some such examples, the control system may be capable of controlling the speaker system based, at least in part, on the personalized hearing profile data.

According to some implementations, causing the apparatus to provide spatialization indications may involve rendering a sound corresponding with the first environmental element to a location in a virtual acoustic space that corresponds with the headset coordinate location of the first environmental element. Locations in the virtual acoustic space may, for example, be determined with reference to a position of a virtual listener's head. In some examples, an origin of the headset coordinate system may correspond with a point inside the virtual listener's head.

At least some aspects of the present disclosure may be implemented via methods. For example, some such methods may involve receiving (e.g., via an interface system) personnel location data indicating a location of at least one person. According to some examples, a method may involve receiving (e.g., from a headset orientation system) headset orientation data corresponding with an orientation of a headset. In some implementations, a method may involve determining first environmental element location data indicating a location of at least a first environmental element.

Some such methods may involve determining, based at least in part on the headset orientation data, the personnel location data and the first environmental element location data, headset coordinate locations of at least one person and at least the first environmental element in a headset coordinate system corresponding with the orientation of the headset. According to some such examples, a method may involve providing control signals for causing an apparatus to provide spatialization indications of the headset coordinate locations, wherein providing the spatialization indications may involve controlling a speaker system of the apparatus to provide environmental element sonification corresponding with at least the first environmental element location data.

In some examples, providing control signals for causing the apparatus to provide spatialization indications may involve providing control signals for controlling the speaker system to provide personnel sonification corresponding with the personnel location data of at least one person. The first environmental element may, in some instances, be a stationary environmental element. If the apparatus includes a display system, providing control signals for causing the apparatus to provide spatialization indications may involve providing control signals for controlling the display system to display at least one of a personnel location or an environmental element location.

Some or all of the methods described herein may be performed by one or more devices according to instructions (e.g., software) stored on non-transitory media. Such non-transitory media may include memory devices such as those described herein, including but not limited to random access memory (RAM) devices, read-only memory (ROM) devices, etc. Accordingly, some innovative aspects of the subject matter described in this disclosure can be implemented in a non-transitory medium having software stored thereon.

For example, the software may include instructions for receiving (e.g., via an interface system of a device) personnel location data indicating a location of at least one person. According to some examples, the software may include instructions for receiving (e.g., from a headset orientation system) headset orientation data corresponding with an orientation of a headset. In some implementations, the software may include instructions for determining first environmental element location data indicating a location of at least a first environmental element. According to some implementations, the first environmental element may be a stationary environmental element. In some examples, the software may include instructions for determining, based at least in part on the headset orientation data, the personnel location data and the first environmental element location data, headset coordinate locations of at least one person and at least the first environmental element in a headset coordinate system corresponding with the orientation of the headset.

According to some such implementations, the software may include instructions for providing control signals for causing an apparatus to provide spatialization indications of the headset coordinate locations. In some examples, providing the spatialization indications may involve controlling a speaker system of the apparatus to provide environmental element sonification corresponding with at least the first environmental element location data. Alternatively, or additionally, providing control signals for causing the apparatus to provide spatialization indications may involve providing control signals for controlling the speaker system to provide personnel sonification corresponding with the personnel location data of at least one person. If the apparatus includes a display system, providing control signals for causing the apparatus to provide spatialization indications may involve providing control signals for controlling the display system to display a personnel location, an environmental element location, or both.

Details of one or more implementations of the subject matter described in this specification are set forth in the accompanying drawings and the description below. Other features, aspects, and advantages will become apparent from the description, the drawings, and the claims. Note that the relative dimensions of the following figures may not be drawn to scale.

BRIEF DESCRIPTION OF THE DRAWINGS

Like reference numbers and designations in the various drawings indicate like elements.

DESCRIPTION OF EXAMPLE EMBODIMENTS

The following description is directed to certain implementations for the purposes of describing some innovative aspects of this disclosure, as well as examples of contexts in which these innovative aspects may be implemented. However, the teachings herein can be applied in various different ways. For example, while various implementations are described in terms of particular applications and environments, the teachings herein are widely applicable to other known applications and environments. Moreover, the described implementations may be implemented, at least in part, in various devices and systems as hardware, software, firmware, cloud-based systems, etc. Accordingly, the teachings of this disclosure are not intended to be limited to the implementations shown in the figures and/or described herein, but instead have wide applicability.

As used herein, the term "audio object" refers to audio signals (also referred to herein as "audio object signals") and associated metadata that may be created or "authored" without reference to any particular playback environment. The associated metadata may include audio object position data, audio object gain data, audio object size data, audio object trajectory data, etc. As used herein, the term "rendering" refers to a process of transforming audio objects into speaker feed signals for a playback environment, which may be an actual playback environment or a virtual playback environment. A rendering process may be performed, at least in part, according to the associated metadata and according to playback environment data. The playback environment data may include an indication of a number of speakers in a playback environment and an indication of the location of each speaker within the playback environment.

Figure 1:
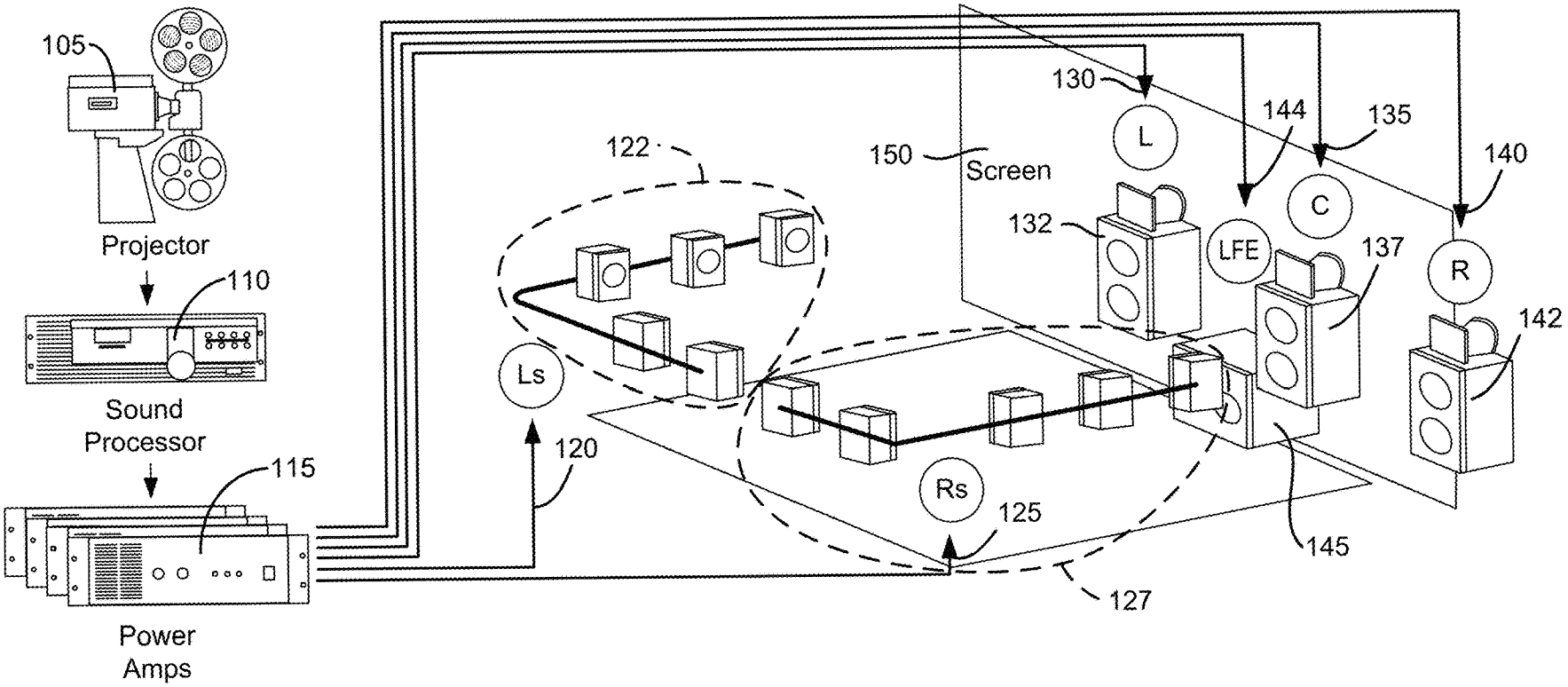
FIG. 1 shows an example of a playback environment having a Dolby Surround 5.1 configuration.

FIG. 1 shows an example of a playback environment having a Dolby Surround 5.1 configuration. In this example, the playback environment is a cinema playback environment. Dolby Surround 5.1 was developed in the 1990s, but this configuration is still widely deployed in home and cinema playback environments. In a cinema playback environment, a projector 105 may be configured to project video images, e.g. for a movie, on a screen 150. Audio data may be synchronized with the video images and processed by the sound processor 110. The power amplifiers 115 may provide speaker feed signals to speakers of the playback environment 100.

The Dolby Surround 5.1 configuration includes a left surround channel 120 for the left surround array 122 and a right surround channel 125 for the right surround array 127. The Dolby Surround 5.1 configuration also includes a left channel 130 for the left speaker array 132, a center channel 135 for the center speaker array 137 and a right channel 140 for the right speaker array 142. In a cinema environment, these channels may be referred to as a left screen channel, a center screen channel and a right screen channel, respectively. A separate low-frequency effects (LFE) channel 144 is provided for the subwoofer 145.

Figure 2:
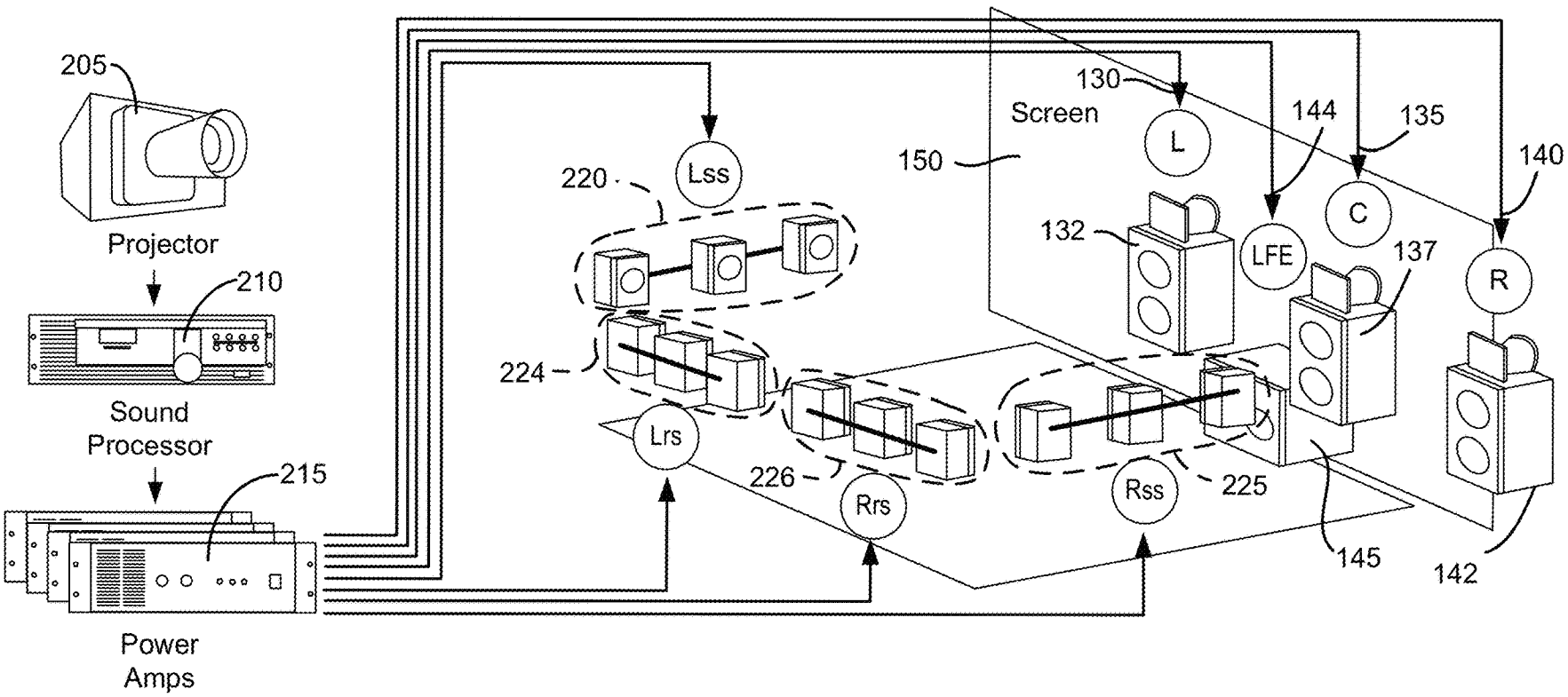
FIG. 2 shows an example of a playback environment having a Dolby Surround 7.1 configuration.

In 2010, Dolby provided enhancements to digital cinema sound by introducing Dolby Surround 7.1. FIG. 2 shows an example of a playback environment having a Dolby Surround 7.1 configuration. A digital projector 205 may be configured to receive digital video data and to project video images on the screen 150. Audio data may be processed by the sound processor 210. The power amplifiers 215 may provide speaker feed signals to speakers of the playback environment 200.

Like Dolby Surround 5.1, the Dolby Surround 7.1 configuration includes a left channel 130 for the left speaker array 132, a center channel 135 for the center speaker array 137, a right channel 140 for the right speaker array 142 and an LFE channel 144 for the subwoofer 145. The Dolby Surround 7.1 configuration includes a left side surround (Lss) array 220 and a right side surround (Rss) array 225, each of which may be driven by a single channel.

However, Dolby Surround 7.1 increases the number of surround channels by splitting the left and right surround channels of Dolby Surround 5.1 into four zones: in addition to the left side surround array 220 and the right side surround array 225, separate channels are included for the left rear surround (Lrs) speakers 224 and the right rear surround (Rrs) speakers 226. Increasing the number of surround zones within the playback environment 200 can significantly improve the localization of sound.

In an effort to create a more immersive environment, some playback environments may be configured with increased numbers of speakers, driven by increased numbers of channels. Moreover, some playback environments may include speakers deployed at various elevations, some of which may be "height speakers" configured to produce sound from an area above a seating area of the playback environment.

Figure 3A:
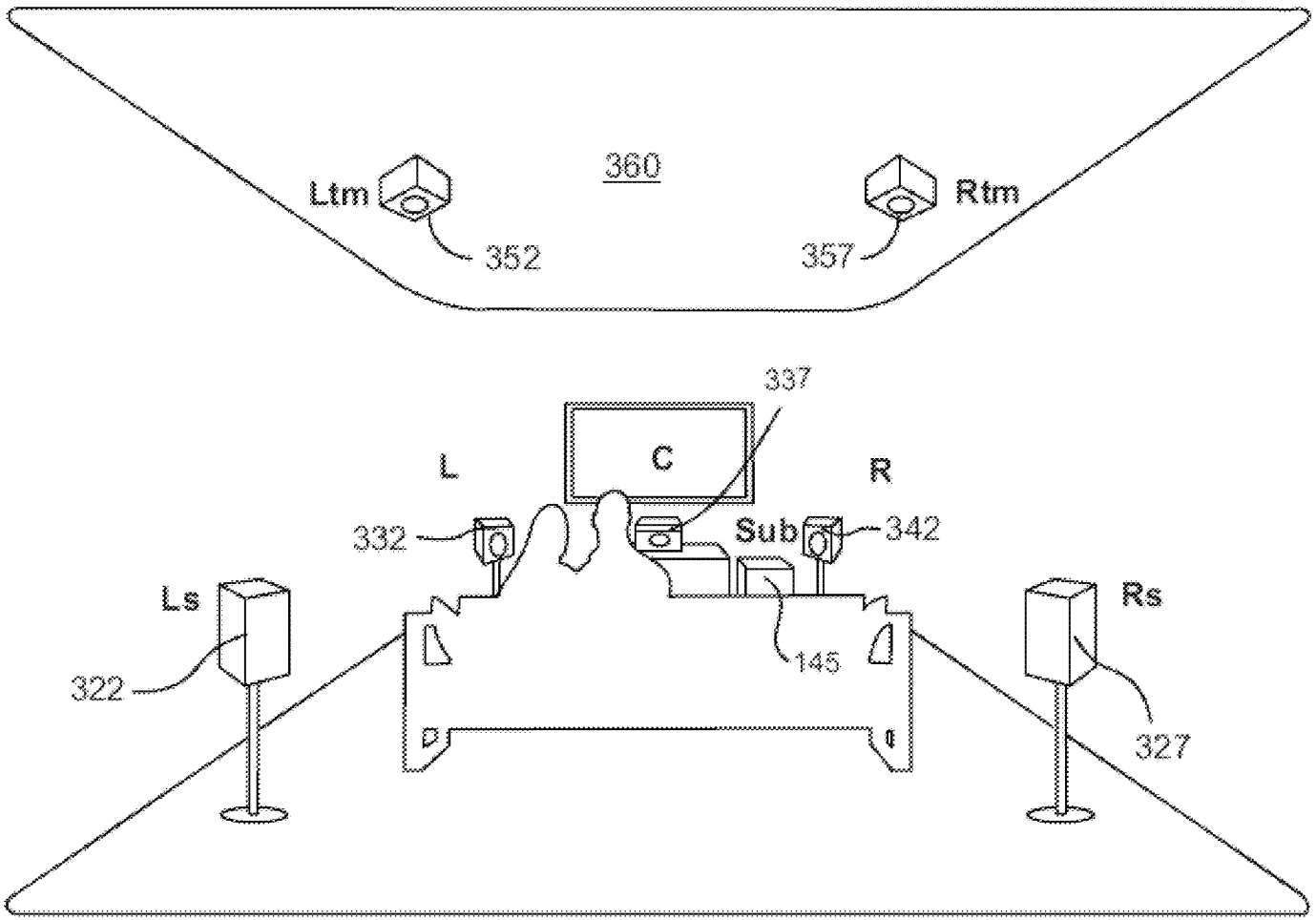
FIGS. 3A and 3B illustrate two examples of home theater playback environments that include height speaker configurations.
Figure 3B:
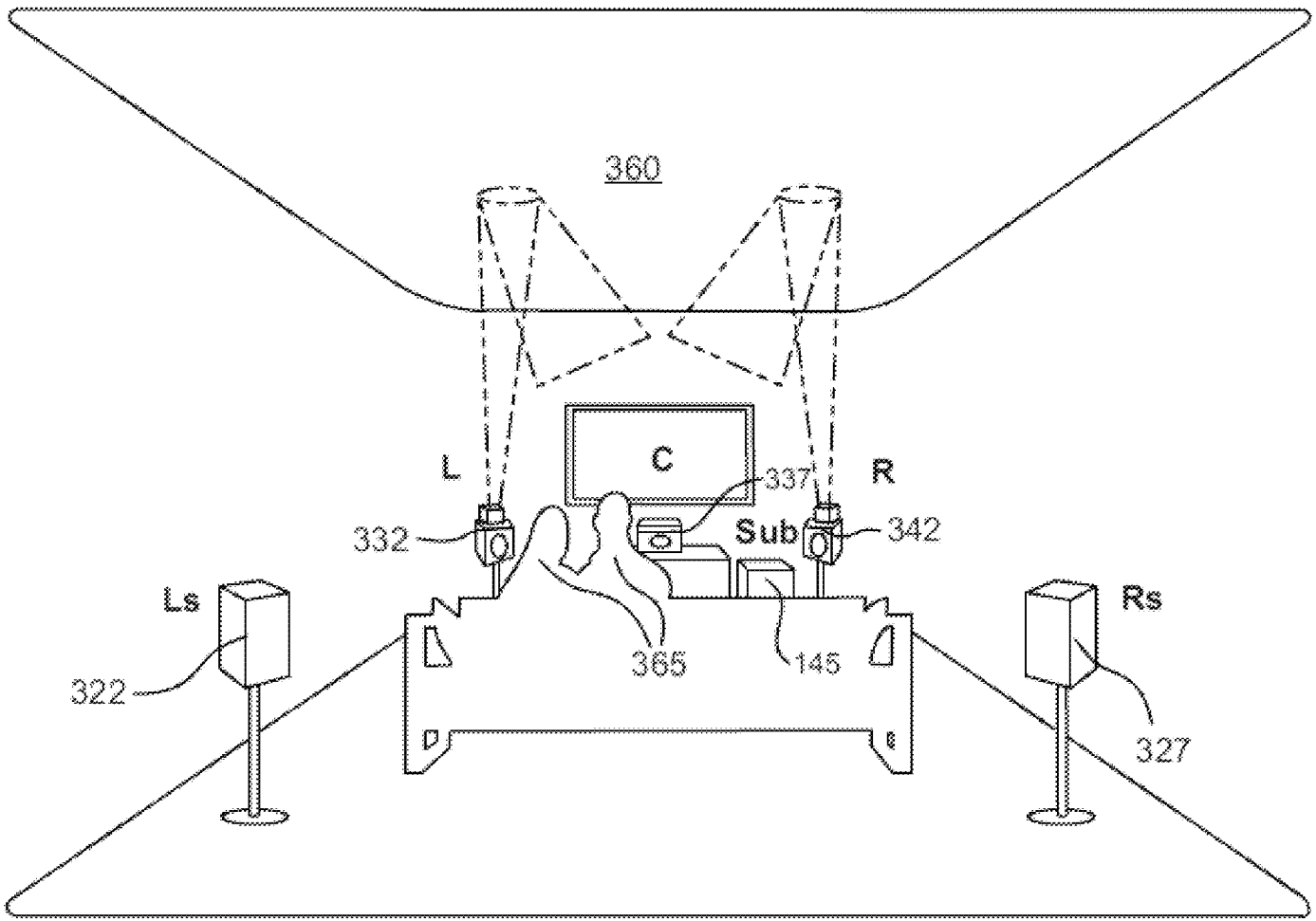

FIGS. 3A and 3B illustrate two examples of home theater playback environments that include height speaker configurations. In these examples, the playback environments 300*a* and 300*b* include the main features of a Dolby Surround 5.1 configuration, including a left surround speaker 322, a right surround speaker 327, a left speaker 332, a right speaker 342, a center speaker 337 and a subwoofer 145. However, the playback environment 300 includes an extension of the Dolby Surround 5.1 configuration for height speakers, which may be referred to as a Dolby Surround 5.1.2 configuration.

FIG. 3A illustrates an example of a playback environment having height speakers mounted on a ceiling 360 of a home theater playback environment. In this example, the playback environment 300*a* includes a height speaker 352 that is in a left top middle (Ltm) position and a height speaker 357 that is in a right top middle (Rtm) position. In the example shown in FIG. 3B, the left speaker 332 and the right speaker 342 are Dolby Elevation speakers that are configured to reflect sound from the ceiling 360. If properly configured, the reflected sound may be perceived by listeners 365 as if the sound source originated from the ceiling 360. However, the number and configuration of speakers is merely provided by way of example. Some current home theater implementations provide for up to 34 speaker positions, and contemplated home theater implementations may allow yet more speaker positions.

Accordingly, the modern trend is to include not only more speakers and more channels, but also to include speakers at differing heights. As the number of channels increases and the speaker layout transitions from 2D to 3D, the tasks of positioning and rendering sounds becomes increasingly difficult.

Accordingly, Dolby has developed various tools, including but not limited to user interfaces, which increase functionality and/or reduce authoring complexity for a 3D audio sound system. Some such tools may be used to create audio objects and/or metadata for audio objects.

Figure 4A:
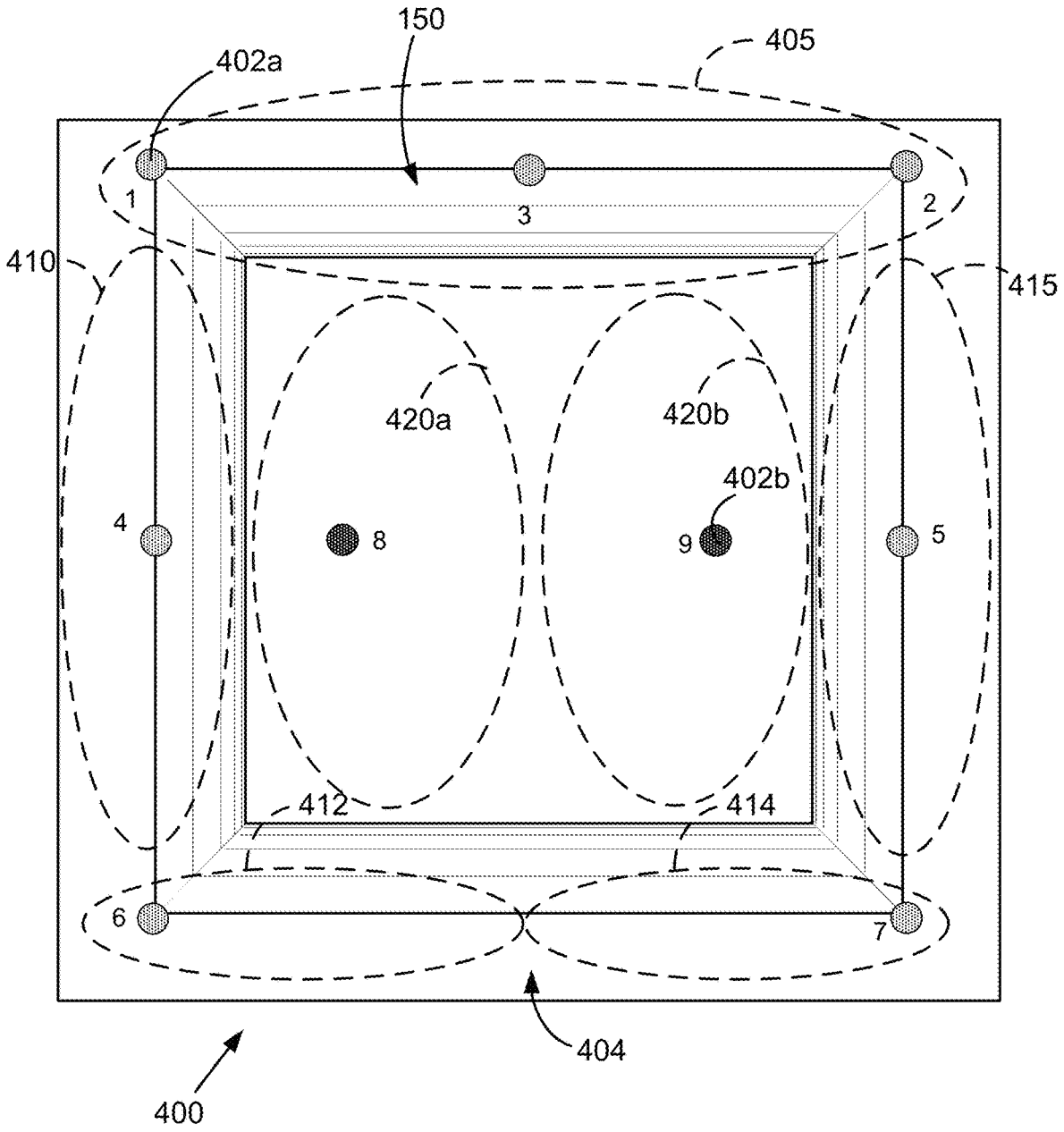
FIG. 4A shows an example of a graphical user interface (GUI) that portrays speaker zones at varying elevations in a virtual playback environment.

FIG. 4A shows an example of a graphical user interface (GUI) that portrays speaker zones at varying elevations in a virtual playback environment. GUI 400 may, for example, be displayed on a display device according to instructions from a logic system, according to signals received from user input devices, etc. Some such devices are described below with reference to FIG. 11.

As used herein with reference to virtual playback environments such as the virtual playback environment 404, the term "speaker zone" generally refers to a logical construct that may or may not have a one-to-one correspondence with a speaker of an actual playback environment. For example, a "speaker zone location" may or may not correspond to a particular speaker location of a cinema playback environment. Instead, the term "speaker zone location" may refer generally to a zone of a virtual playback environment. In some implementations, a speaker zone of a virtual playback environment may correspond to a virtual speaker, e.g., via the use of virtualizing technology such as Dolby Headphone™ (sometimes referred to as Mobile Surround™), which creates a virtual surround sound environment in real time using a set of two-channel stereo headphones. In GUI 400, there are seven speaker zones 402*a* at a first elevation and two speaker zones 402*b* at a second elevation, making a total of nine speaker zones in the virtual playback environment 404. In this example, speaker zones 1-3 are in the front area 405 of the virtual playback environment 404. The front area 405 may correspond, for example, to an area of a cinema playback environment in which a screen 150 is located, to an area of a home in which a television screen is located, etc.

Here, speaker zone 4 corresponds generally to speakers in the left area 410 and speaker zone 5 corresponds to speakers in the right area 415 of the virtual playback environment 404. Speaker zone 6 corresponds to a left rear area 412 and speaker zone 7 corresponds to a right rear area 414 of the virtual playback environment 404. Speaker zone 8 corresponds to speakers in an upper area 420*a* and speaker zone 9 corresponds to speakers in an upper area 420*b*, which may be a virtual ceiling area. Accordingly, the locations of speaker zones 1-9 that are shown in FIG. 4A may or may not correspond to the locations of speakers of an actual playback environment. Moreover, other implementations may include more or fewer speaker zones and/or elevations.

In various implementations described herein, a user interface such as GUI 400 may be used as part of an authoring tool and/or a rendering tool. In some implementations, the authoring tool and/or rendering tool may be implemented via software stored on one or more non-transitory media. The authoring tool and/or rendering tool may be implemented (at least in part) by hardware, firmware, etc., such as the logic system and other devices described below with reference to FIG. 11. In some authoring implementations, an associated authoring tool may be used to create metadata for associated audio data. The metadata may, for example, include data indicating the position and/or trajectory of an audio object in a three-dimensional space, speaker zone constraint data, etc. The metadata may be created with respect to the speaker zones 402 of the virtual playback environment 404, rather than with respect to a particular speaker layout of an actual playback environment. A rendering tool may receive audio data and associated metadata, and may compute audio gains and speaker feed signals for a playback environment. Such audio gains and speaker feed signals may be computed according to an amplitude panning process, which can create a perception that a sound is coming from a position P in the playback environment. For example, speaker feed signals may be provided to speakers 1 through N of the playback environment according to the following equation:

$$x_i(t)=g_i x(t),\ i=1,\ldots N \qquad \text{(Equation 1)}$$

In Equation 1, $x_i(t)$ represents the speaker feed signal to be applied to speaker $g_i$ represents the gain factor of the corresponding channel, x(t) represents the audio signal and t represents time. The gain factors may be determined, for example, according to the amplitude panning methods described in Section 2, pages 3-4 of V. Pulkki, *Compensating Displacement of Amplitude-Panned Virtual Sources* (Audio Engineering Society (AES) International Conference on Virtual, Synthetic and Entertainment Audio), which is hereby incorporated by reference. In some implementations, the gains may be frequency dependent. In some implementations, a time delay may be introduced by replacing x(t) by $x(t-\Delta t)$.

In some rendering implementations, audio reproduction data created with reference to the speaker zones 402 may be mapped to speaker locations of a wide range of playback environments, which may be in a Dolby Surround 5.1 configuration, a Dolby Surround 7.1 configuration, a Hamasaki 22.2 configuration, or another configuration. For example, referring to FIG. 2, a rendering tool may map audio reproduction data for speaker zones 4 and 5 to the left side surround array 220 and the right side surround array 225 of a playback environment having a Dolby Surround 7.1 configuration. Audio reproduction data for speaker zones 1, 2 and 3 may be mapped to the left screen channel 230, the right screen channel 240 and the center screen channel 235, respectively. Audio reproduction data for speaker zones 6 and 7 may be mapped to the left rear surround speakers 224 and the right rear surround speakers 226.

Figure 4B:
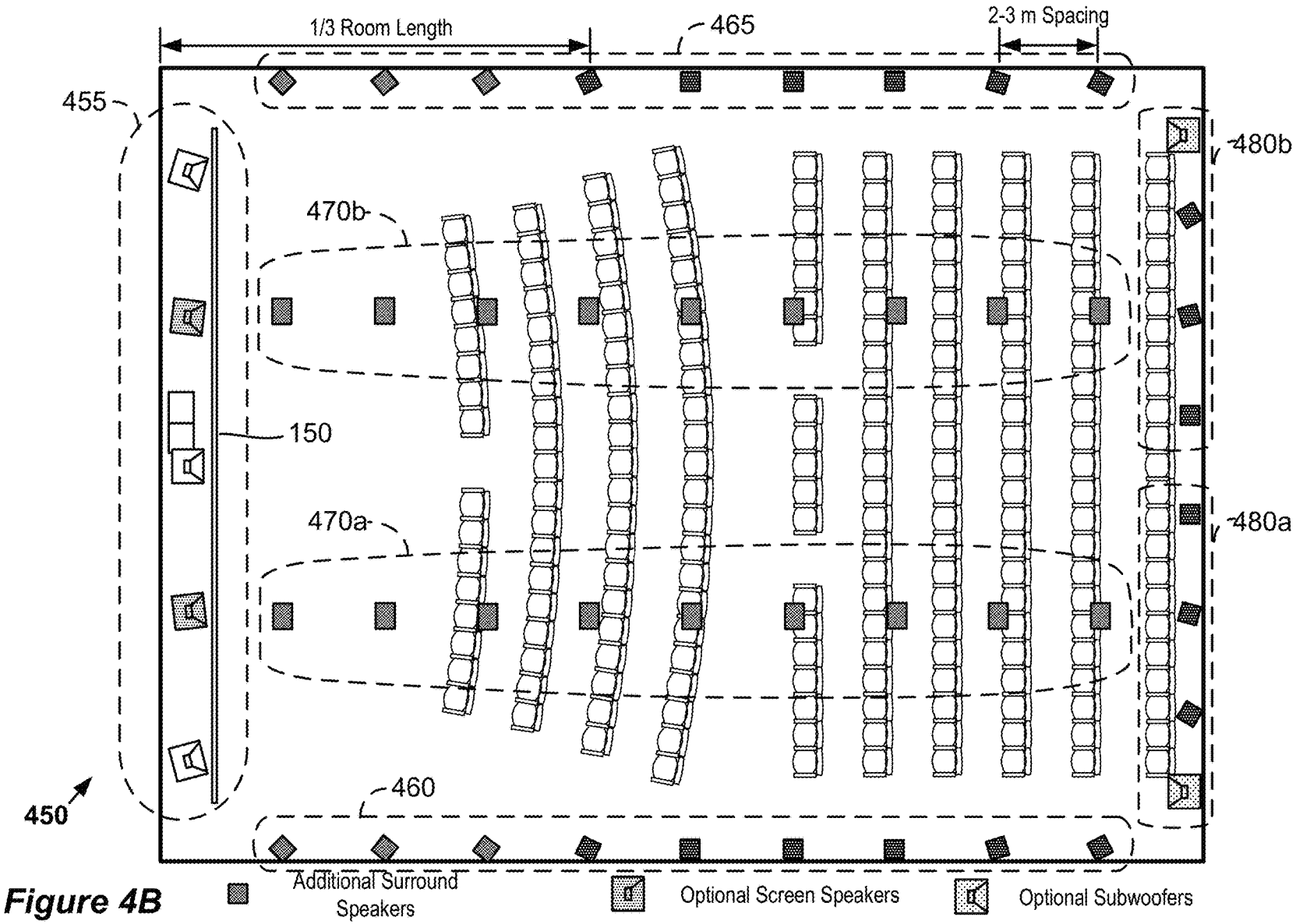
FIG. 4B shows an example of another playback environment.

FIG. 4B shows an example of another playback environment. In some implementations, a rendering tool may map audio reproduction data for speaker zones 1, 2 and 3 to corresponding screen speakers 455 of the playback environment 450. A rendering tool may map audio reproduction data for speaker zones 4 and 5 to the left side surround array 460 and the right side surround array 465 and may map audio reproduction data for speaker zones 8 and 9 to left overhead speakers 470*a* and right overhead speakers 470*b*. Audio reproduction data for speaker zones 6 and 7 may be mapped to left rear surround speakers 480*a* and right rear surround speakers 480*b*.

In some authoring implementations, an authoring tool may be used to create metadata for audio objects. The metadata may indicate the 3D position of the object, rendering constraints, content type (e.g. dialog, effects, etc.) and/or other information. Depending on the implementation, the metadata may include other types of data, such as width data, gain data, trajectory data, etc. Some audio objects may be static, whereas others may move.

Audio objects are rendered according to their associated metadata, which generally includes positional metadata indicating the position of the audio object in a three-dimensional space at a given point in time. When audio objects are monitored or played back in a playback environment, the audio objects are rendered according to the positional metadata using the speakers that are present in the playback environment, rather than being output to a predetermined physical channel, as is the case with traditional, channel-based systems such as Dolby 5.1 and Dolby 7.1.

In addition to positional metadata, other types of metadata may be necessary to produce intended audio effects. For example, in some implementations, the metadata associated with an audio object may indicate audio object size, which may also be referred to as "width." Size metadata may be used to indicate a spatial area or volume occupied by an audio object. A spatially large audio object should be perceived as covering a large spatial area, not merely as a point sound source having a location defined only by the audio object position metadata. In some instances, for example, a large audio object should be perceived as occupying a significant portion of a playback environment, possibly even surrounding the listener.

Spread and apparent source width control are features of some existing surround sound authoring/rendering systems. In this disclosure, the term "spread" refers to distributing the same signal over multiple speakers to blur the sound image. The term "width" (also referred to herein as "size" or "audio object size") refers to decorrelating the output signals to each channel for apparent width control. Width may be an additional scalar value that controls the amount of decorrelation applied to each speaker feed signal.

Figure 5A:
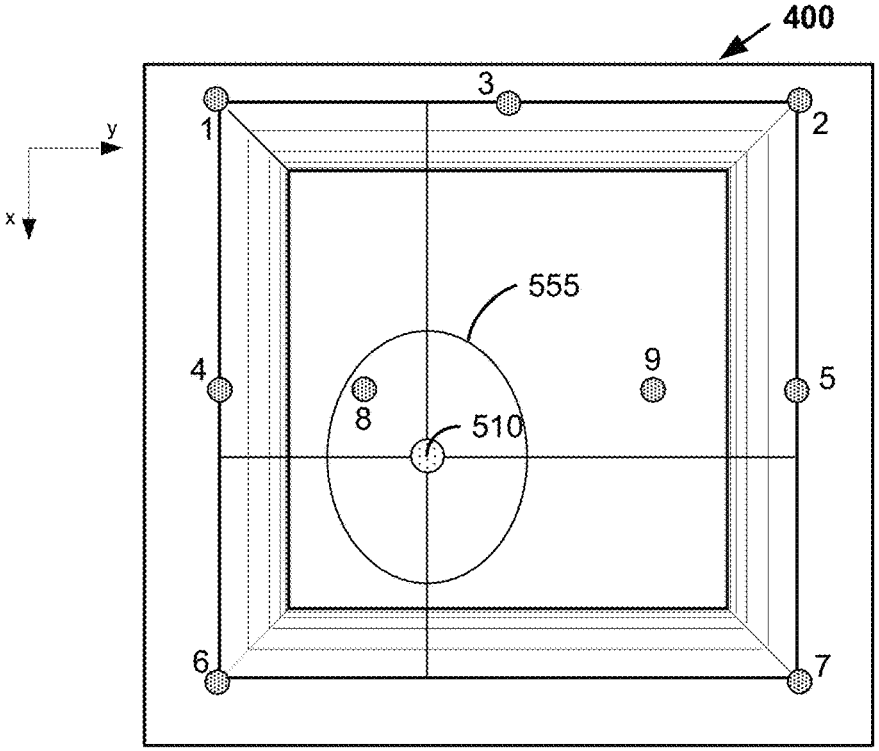
FIG. 5A shows an example of an audio object and associated audio object width in a virtual reproduction environment.

Some implementations described herein provide a 3D axis oriented spread control. One such implementation will now be described with reference to FIGS. 5A and 5B. FIG. 5A shows an example of an audio object and associated audio object width in a virtual reproduction environment. Here, the GUI 400 indicates an ellipsoid 555 extending around the audio object 510, indicating the audio object width or size. The audio object width may be indicated by audio object metadata and/or received according to user input. In this example, the x and y dimensions of the ellipsoid 555 are different, but in other implementations these dimensions may be the same. The z dimensions of the ellipsoid 555 are not shown in FIG. 5A.

Figure 5B:
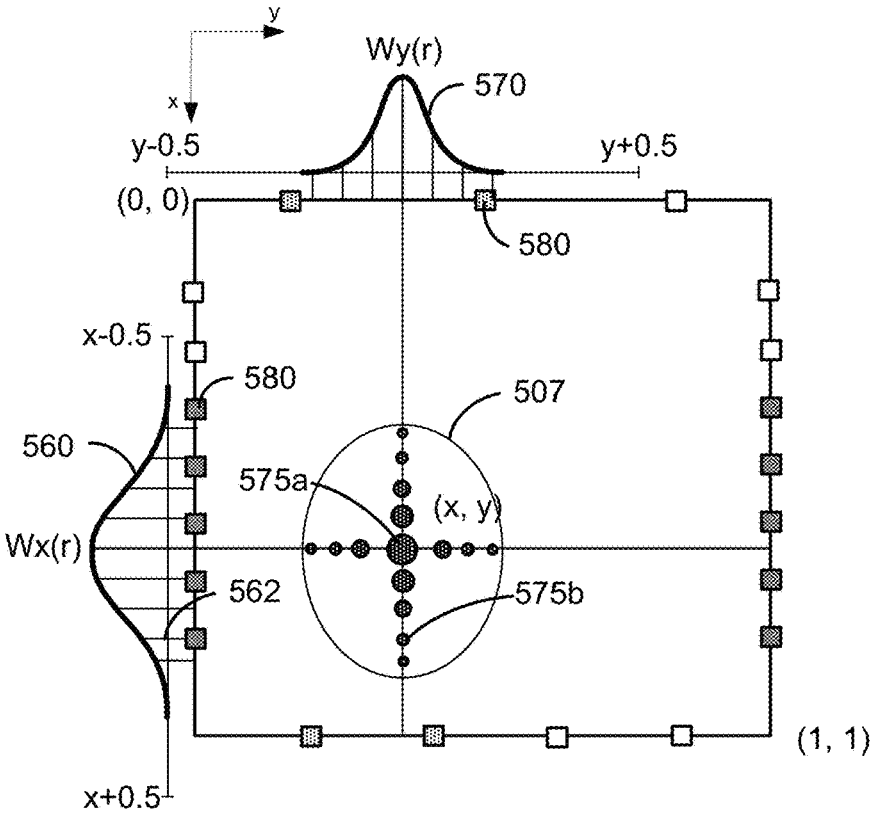
FIG. 5B shows an example of a spread profile corresponding to the audio object width shown in FIG. 5A.

FIG. 5B shows an example of a spread profile corresponding to the audio object width shown in FIG. 5A. Spread may be represented as a three-dimensional vector parameter. In this example, the spread profile 507 can be independently controlled along 3 dimensions, e.g., according to user input. The gains along the x and y axes are represented in FIG. 5B by the respective height of the curves 560 and 1520. The gain for each sample 562 is also indicated by the size of the corresponding circles 575 within the spread profile 507. The responses of the speakers 580 are indicated by gray shading in FIG. 5B.

In some implementations, the spread profile 507 may be implemented by a separable integral for each axis. According to some implementations, a minimum spread value may be set automatically as a function of speaker placement to avoid timbral discrepancies when panning. Alternatively, or additionally, a minimum spread value may be set automatically as a function of the velocity of the panned audio object, such that as audio object velocity increases an object becomes more spread out spatially, similarly to how rapidly moving images in a motion picture appear to blur.

Figure 5C:
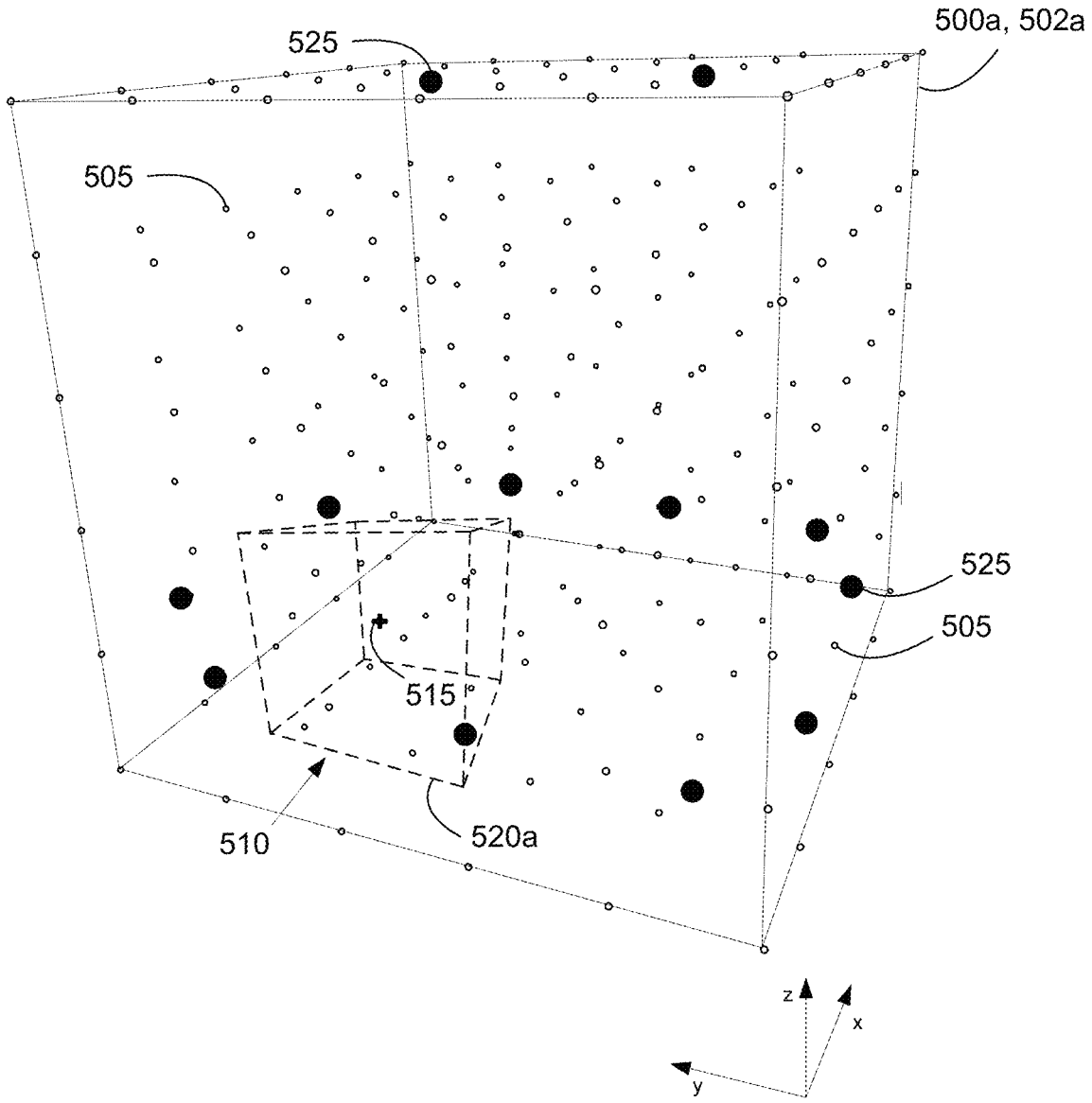
FIG. 5C shows an example of virtual source locations relative to a playback environment.
Figure 5D:
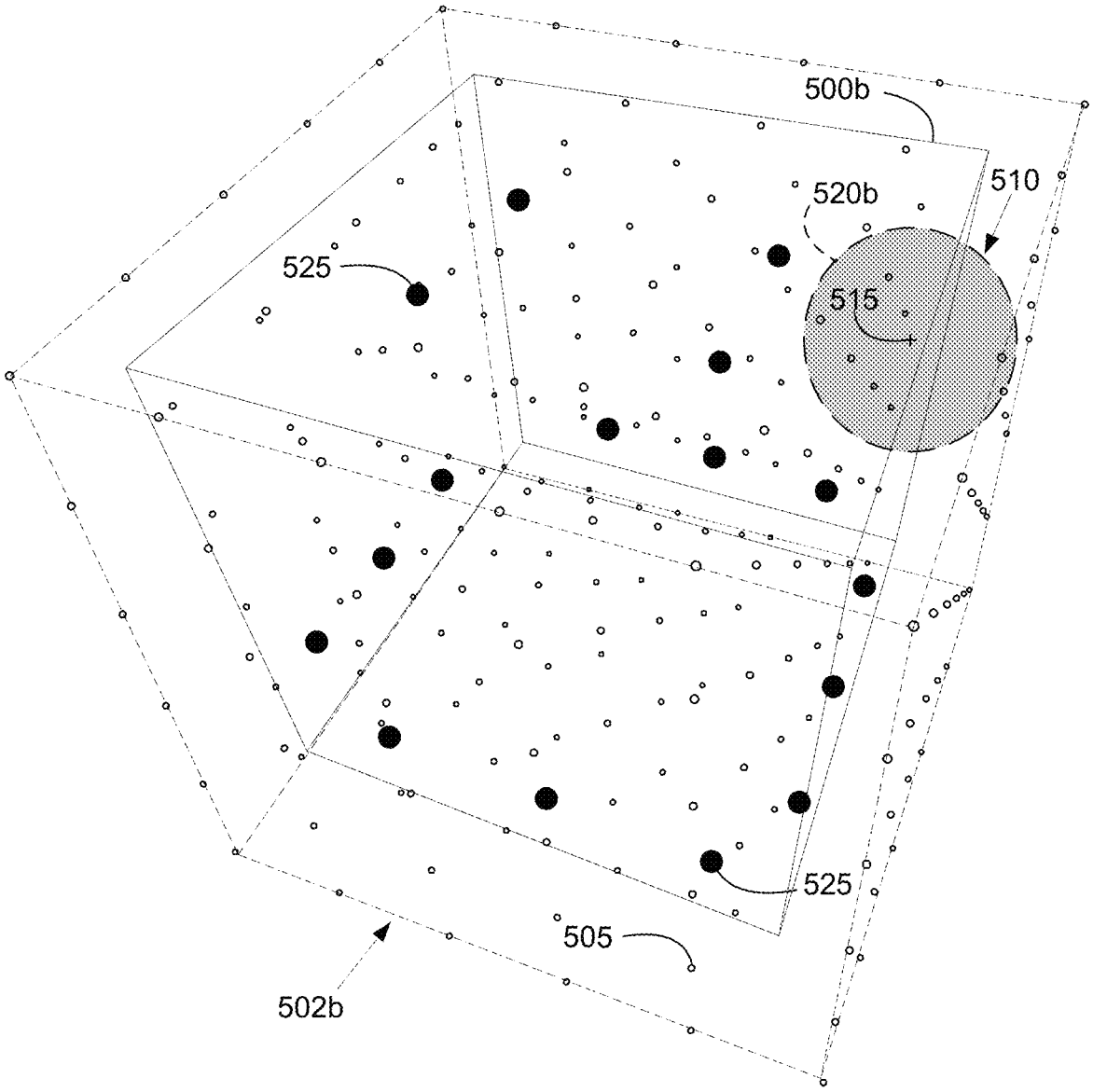
FIG. 5D shows an alternative example of virtual source locations relative to a playback environment.

Some examples of rendering audio object signals to virtual speaker locations will now be described with reference to FIGS. 5C and 5D. FIG. 5C shows an example of virtual source locations relative to a playback environment. The playback environment may be an actual playback environment or a virtual playback environment. The virtual source locations 505 and the speaker locations 525 are merely examples. However, in this example the playback environment is a virtual playback environment and the speaker locations 525 correspond to virtual speaker locations.

In some implementations, the virtual source locations 505 may be spaced uniformly in all directions. In the example shown in FIG. 5A, the virtual source locations 505 are spaced uniformly along x, y and z axes. The virtual source locations 505 may form a rectangular grid of $N_x$ by $N_y$ by $N_z$ virtual source locations 505. In some implementations, the value of N may be in the range of 5 to 100. The value of N may depend, at least in part, on the number of speakers in the playback environment (or expected to be in the playback environment): it may be desirable to include two or more virtual source locations 505 between each speaker location.

However, in alternative implementations, the virtual source locations 505 may be spaced differently. For example, in some implementations the virtual source locations 505 may have a first uniform spacing along the x and y axes and a second uniform spacing along the z axis. In other implementations, the virtual source locations 505 may be spaced non-uniformly.

In this example, the audio object volume 520*a* corresponds to the size of the audio object. The audio object 510 may be rendered according to the virtual source locations 505 enclosed by the audio object volume 520*a*. In the example shown in FIG. 5A, the audio object volume 520*a* occupies part, but not all, of the playback environment 500*a*. Larger audio objects may occupy more of (or all of) the playback environment 500*a*. In some examples, if the audio object 510 corresponds to a point source, the audio object 510 may have a size of zero and the audio object volume 520*a* may be set to zero.

According to some such implementations, an authoring tool may link audio object size with decorrelation by indicating (e.g., via a decorrelation flag included in associated metadata) that decorrelation should be turned on when the audio object size is greater than or equal to a size threshold value and that decorrelation should be turned off if the audio object size is below the size threshold value. In some implementations, decorrelation may be controlled (e.g., increased, decreased or disabled) according to user input regarding the size threshold value and/or other input values.

In this example, the virtual source locations 505 are defined within a virtual source volume 502. In some implementations, the virtual source volume may correspond with a volume within which audio objects can move. In the example shown in FIG. 5A, the playback environment 500*a* and the virtual source volume 502*a* are co-extensive, such that each of the virtual source locations 505 corresponds to a location within the playback environment 500*a*. However, in alternative implementations, the playback environment 500*a* and the virtual source volume 502 may not be co-extensive.

For example, at least some of the virtual source locations 505 may correspond to locations outside of the playback environment. FIG. 5B shows an alternative example of virtual source locations relative to a playback environment. In this example, the virtual source volume 502*b* extends outside of the playback environment 500*b*. Some of the virtual source locations 505 within the audio object volume 520*b* are located inside of the playback environment 500*b* and other virtual source locations 505 within the audio object volume 520*b* are located outside of the playback environment 500*b*.

In other implementations, the virtual source locations 505 may have a first uniform spacing along x and y axes and a second uniform spacing along a z axis. The virtual source locations 505 may form a rectangular grid of $N_x$ by $N_y$ by $M_z$ virtual source locations 505. For example, in some implementations there may be fewer virtual source locations 505 along the z axis than along the x or y axes. In some such implementations, the value of N may be in the range of 10 to 100, whereas the value of M may be in the range of 5 to 10.

Some implementations involve computing gain values for each of the virtual source locations 505 within an audio object volume 520. In some implementations, gain values for each channel of a plurality of output channels of a playback environment (which may be an actual playback environment or a virtual playback environment) will be computed for each of the virtual source locations 505 within an audio object volume 520. In some implementations, the gain values may be computed by applying a vector-based amplitude panning ("VBAP") algorithm, a pairwise panning algorithm or a similar algorithm to compute gain values for point sources located at each of the virtual source locations 505 within an audio object volume 520. In other implementations, a separable algorithm, to compute gain values for point sources located at each of the virtual source locations 505 within an audio object volume 520. As used herein, a "separable" algorithm is one for which the gain of a given speaker can be expressed as a product of multiple factors (e.g., three factors), each of which depends only on one of the coordinates of the virtual source location 505. Examples include algorithms implemented in various existing mixing console panners, including but not limited to the Pro Tools™ software and panners implemented in digital film consoles provided by AMS Neve.

In some implementations, a virtual acoustic space may be represented as an approximation to the sound field at a point (or on a sphere). Some such implementations may involve projecting a set of orthogonal basis functions on a sphere. In some such representations, which are based on Ambisonics, the basis functions are spherical harmonics. In such a format, a source at azimuth angle θ and an elevation φ will be panned with different gains onto the first 4 W, X, Y and Z basis functions. In some such examples, the gains may be given by the following equations:

$$W = S \cdot \frac{1}{\sqrt{2}}$$

$$W = S \cdot \cos\theta \cos\phi$$

$$Y - S \cdot \sin\theta \cos\phi$$

$$Z = S \cdot \sin\phi$$

Figure 5E:
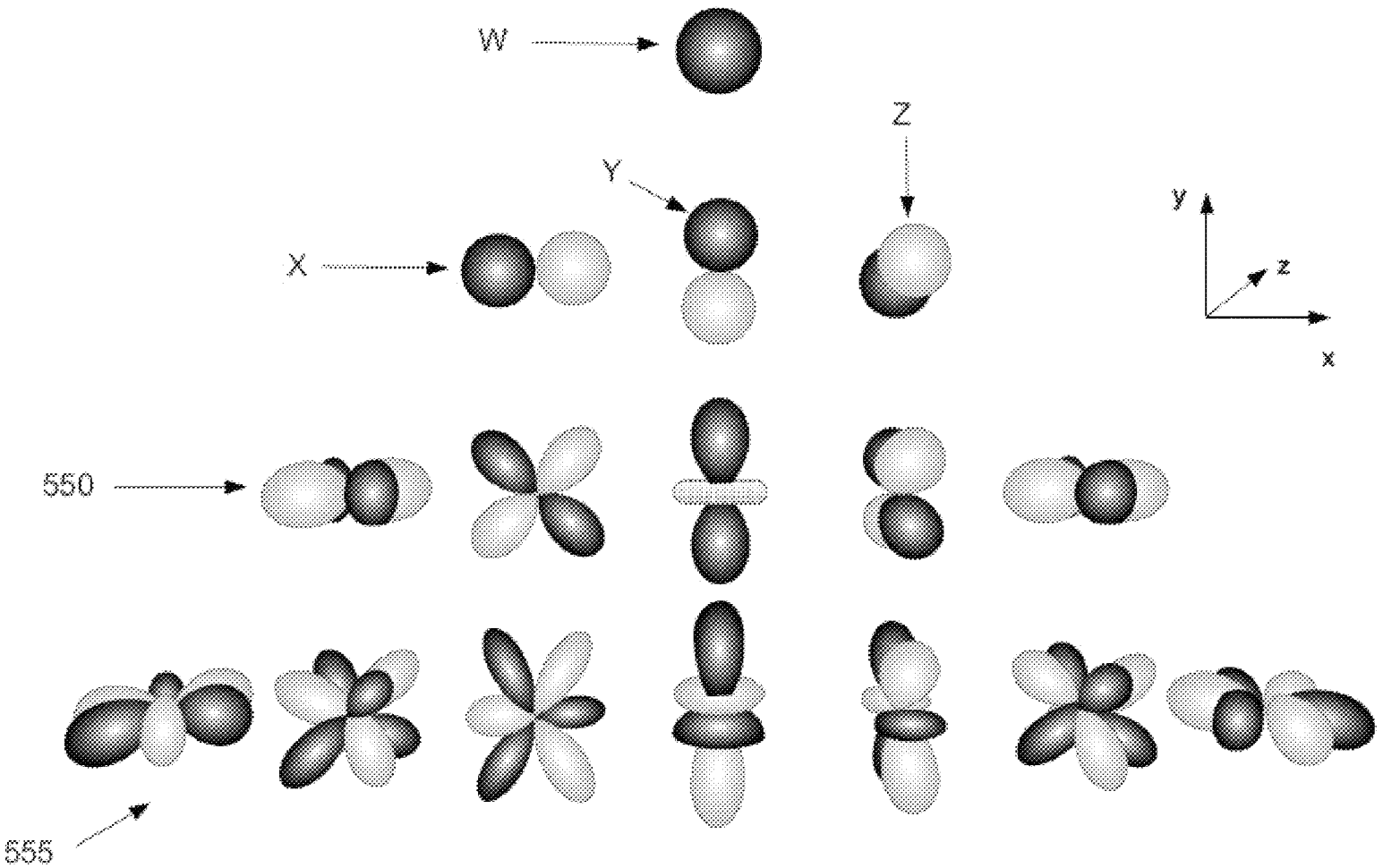
FIG. 5E shows examples of W, X, Y and Z basis functions.

FIG. 5E shows examples of W, X, Y and Z basis functions. In this example, the omnidirectional component W is independent of angle. The X, Y and Z components may, for example, correspond to microphones with a dipole response, oriented along the X, Y and Z axes. Higher order components, examples of which are shown in rows 550 and 555 of FIG. 5E, can be used to achieve greater spatial accuracy.

Mathematically the spherical harmonics are solutions of Laplace's equation in 3 dimensions, and are found to have the form $Y_t^m(\theta, p) - N e^{tmp} p_t^m(\cos\theta)$, in which m represents an integer, N represents a normalization constant and $P_t^{rm}$ represents a Legendre polynomial. However, in some implementations the above functions may be represented in rectangular coordinates rather the spherical coordinates used above.

This application discloses augmented hearing systems that may advantageously be used by people in a variety of situations, including but not limited to use by military personnel (such as infantry and other ground soldiers) who may be training for, or involved in, combat operations. During combat operations, the demands on the sensory system of a ground soldier may be substantial and at times potentially overwhelming. Moreover, the consequences of delayed reactions and attentional overload may be significant and in some instances life-threatening. Some situations may require split-second life-or-death decisions. Incoming and outgoing gunfire may be persistent and explosions may be common. Injured squad members may be in need of attention and/or covering fire.

In a combat situation, communications may be critical. Military personnel often may be in communication with other personnel, such as squad members. In some situations, information may need to be passed via radio communications between multiple groups, often via multiple radio frequencies, e.g., between team members, with one or more supporting units, with a forward operating base, with higher-level command center (e.g., for air support and reinforcements) and/or with artillery or air assets in the vicinity. Some soldiers will be required to communicate with multiple groups using multiple radios.

Sensory awareness also may be critical. In a combat environment, the human sensory system of a ground soldier should be working as efficiently and effectively as possible. Both response speed and response accuracy could potentially increase if multiple sensory channels (e.g., sonic, visual, haptic) were available to represent information. However, previously-deployed combat gear does not generally provide such capabilities.

A soldier's knowledge of his or her position and that of squad members, geographical landmarks, etc., is also very important. However, it may be challenging for a soldier to achieve and maintain knowledge of his or her position. A soldier may become disoriented for a variety of reasons. Knowing the location of squad members may be challenging, in part because squad members may be spread out over an area and may be changing their positions over time. During combat, squad members will generally be doing their best to avoid observation. In some situations, such as darkness, operations in dense vegetation, etc., it may be difficult to maintain awareness of the locations of both squad members and environmental elements. Some environmental elements, such as geographic features, compass positions (such as the direction of true north or magnetic north), etc., may be stationary. However, other environmental elements, such as vehicles, aircraft, gunfire, explosions, etc., may change their positions over time.

Figure 6:
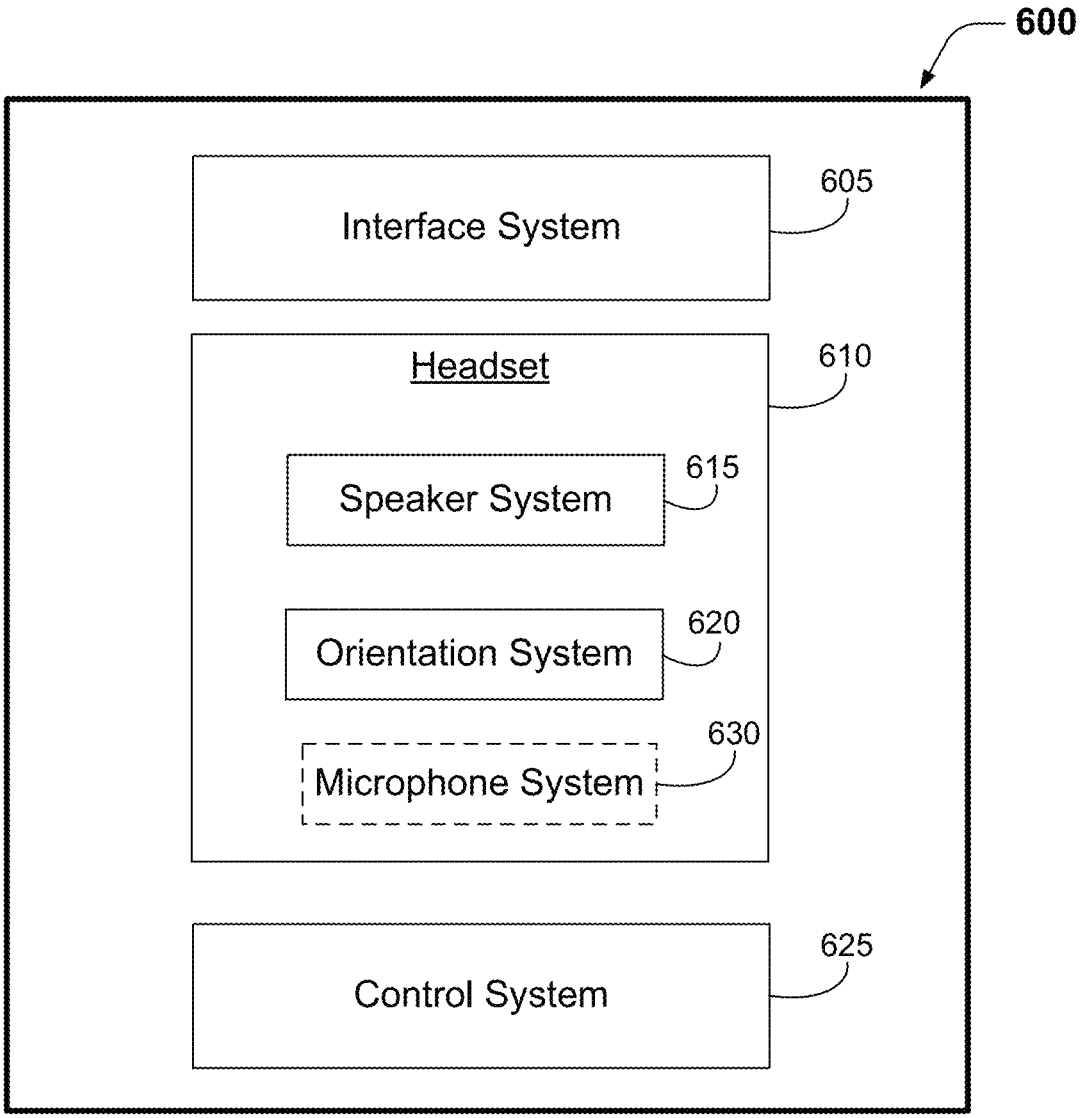
FIG. 6 is a block diagram that shows examples of components of an apparatus capable of implementing various aspects of this disclosure.

FIG. 6 is a block diagram that shows examples of components of an apparatus capable of implementing various aspects of this disclosure. The apparatus 600 may be implemented via hardware, via software stored on non-transitory media, via firmware and/or by combinations thereof. As with the other implementations disclosed herein, the types and numbers of components shown in FIG. 6 are merely shown by way of example. Alternative implementations may include more, fewer and/or different components. In some examples, the apparatus 600 may be a component of another device or of another system.

In this example, the apparatus 600 includes an interface system 605, a headset 610 and a control system 625. In some implementations, the interface system 605 may include one or more wireless interfaces suitable for radio frequency communications. According to some examples, the interface system 605 may include a Global Positioning System (GPS) receiver. The interface system 605 may include one or more network interfaces and/or one or more an external device interfaces (such as one or more universal serial bus (USB) interfaces). The interface system 605 may include one or more types of user interface, such as a touch sensor system, a gesture sensor system, a system for processing voice commands, one or more buttons, knobs, keys, etc.

The control system 625 may, for example, include a general purpose single- or multi-chip processor, a digital signal processor (DSP), an application specific integrated circuit (ASIC), a field programmable gate array (FPGA) or other programmable logic device, discrete gate or transistor logic, and/or discrete hardware components. Although not expressly shown in FIG. 6, in some implementations the apparatus may include a memory system, which may include one or more types of non-transitory media. Such non-transitory media may include memory devices such as random access memory (RAM) devices, read-only memory (ROM) devices, etc. At least some of the memory system may be part of the control system 625, whereas other components of the memory system may be external to the control system 625. In some such implementations, the interface system 605 may include one or more interfaces between the control system 625 and at least a part of the memory system.

In this example, the headset 610 includes a speaker system 615 and an orientation system 620. However, in alternative some implementations, the orientation system 620 may be separate from the headset 610. In some implementations, the orientation system 620 may include one or more types of sensor, such as one or more accelerometers, magnetometers and/or gyroscopes. Some implementations of the orientation system 620 may include 3-axis accelerometers, magnetometers and/or gyroscopes. In some examples, the orientation system 620 may include one or more inertial measurement units (IMUs). According to some such examples, the orientation system 620 may be capable of determining the orientation, position and/or velocity of the headset 610. In some implementations, the orientation system 620 and/or the control system 625 may be capable of determining the orientation of the headset 610 at least in part according to accelerometer data, by reference to the gravitational vector (g-force) which may be determined according to accelerometer measurements. According to some examples, the orientation system 620 and/or the control system 625 may be capable of determining the orientation of the headset 610 with reference to the earth's magnetic field by reference to magnetometer data.

In some examples, the orientation system 620 and/or the control system 625 may be capable of determining the orientation of the headset 610 by integrating gyroscope data, indicating the measured angular velocity of the headset 610, over time. However, in some implementations, such orientation measurements may tend to "drift," due to errors that accumulate over time.

In some examples, the orientation system 620 and/or the control system 625 may be capable of correcting for drift, noise, or errors (such as accumulated errors) of one or more sensors. For example, errors in position calculation may be corrected according to GPS data received via the interface system 605. Magnetometer data and accelerometer data may be used to correct orientation drift, by reference to the earth's magnetic and gravitational fields, respectively.

In some implementations, sensor data from multiple sensors may be combined in order to reduce errors. According to some implementations, sensor data from multiple sensors may be combined and filtered, e.g., by a Kalman filter. Some such methods are described in Stubberud, P. A.; Stubberud, A. R. A Signal Processing Technique for Improving the Accuracy of MEMS Inertial Sensors. *In Proceedings of the 19th International Conference on Systems Engineering*, Las Vegas, Nev., USA, 19-21 Aug. 2008; pp. 13-18, and in Guerrier, S. Improving Accuracy with Multiple Sensors: Study of Redundant MEMS-IMU/GPS Configurations, in *Proceedings of the 22nd International Technical Meeting of The Satellite Division of the Institute of Navigation* (*ION GNSS* 2009), Savannah, Ga., USA, 22-25 Sep. 2009; pp. 3114-3121, both of which are hereby incorporated by reference.

In some examples, the orientation system 620 and/or the control system 625 may be capable of combining accelerator and gyroscope data. According to some such implementations, the orientation system 620 and/or the control system 625 may be capable of combining accelerator and gyroscope data in order to avoid accumulated errors that could otherwise result from determining the orientation of the headset 610 based primarily on gyroscope data. In some such implementations, the orientation system 620 and/or the control system 625 may be capable of combining accelerator and gyroscope data via a complementary filter in order to correct for accumulated errors in the angular orientation of the headset 610. According to some such examples, the complementary filter may be implemented according to the following equation:

$$A_t = C_1(A_{t-1} + D_{gyro}dt) + C_2(D_{acc}) \quad \text{(Equation 2)}$$

In Equation 2, $A_t$ represents an angular orientation at time t, $A_{t-1}$ represents the angular orientation at time t−1, $D_{gyro}$ represents gyroscope data, $D_{acc}$ represents accelerometer data, and $C_1$ and $C_2$ represent constants that sum to 1. In some examples, $C_1$ is close to 1 (e.g., in the range from 0.95 to 0.99) and $C_2$ is close to zero (e.g., in the range from 0.05 to 0.01).

In some implementations, the speaker system 615 may include one or more conventional speakers, such as speakers that are commonly provided with headphones. However, as described in detail herein, the speaker system 615 may be controlled to provide functionality that prior art devices are not capable of providing.

In some implementations, the headset 610 may provide at least some degree of ear protection functionality, such as noise cancellation functionality. According to some such implementations, the headset 610 may be capable of adaptively attenuating environmental noise. In some such implementations, the headset 610 may be capable of adaptively attenuating environmental noise based, at least in part, on microphone data from the optional microphone system 630. The microphone system 630, when present, includes at least one microphone and, in some implementations, includes two or more microphones. At least a portion of the microphone system 630 may be in the headset 610. In some such implementations, the headset 610 may be capable of adaptively attenuating environmental noise based, at least in part, on instructions from the control system. Some such implementations may apply noise-cancellation processes known in the art, such as those that involve create a noise-cancelling wave that is 180° out of phase with ambient noise, as detected by the microphone system 630.

Figure 7:
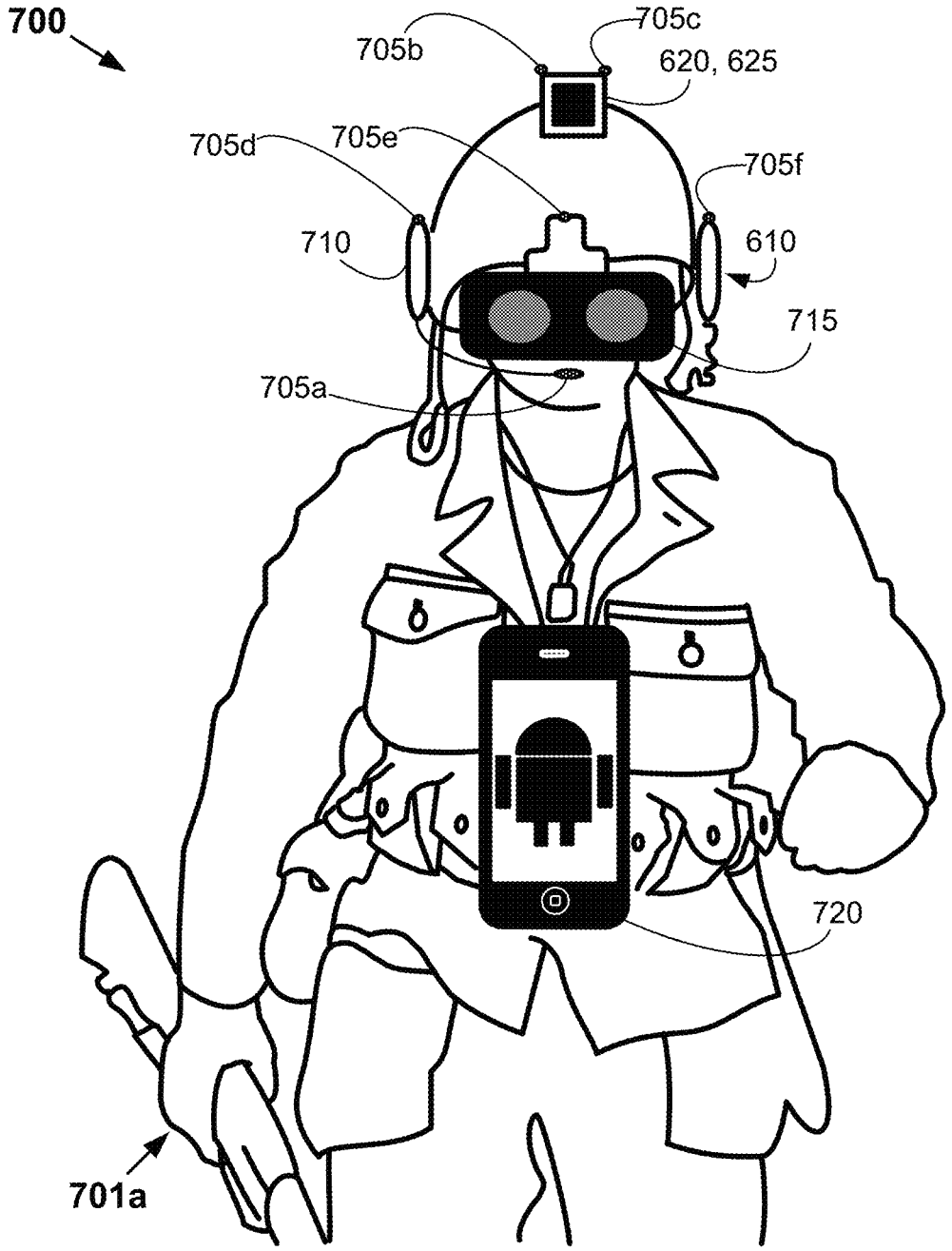
FIG. 7 depicts a soldier equipped with example elements of an augmented hearing system.

FIG. 7 depicts a soldier equipped with example elements of an augmented hearing system. As with the other implementations disclosed herein, the types and numbers of components shown in FIG. 7 are merely shown by way of example. Alternative implementations may include more, fewer and/or different components. The augmented hearing system 700 may include the elements shown in FIG. 6 and described above. In this example, the augmented hearing system 700 includes a headset 610, which includes a speaker system 615 (not shown) disposed within headphone units 710, an orientation system 620, at least a portion of a control system 625, and a microphone 705*a* of a microphone system 630.

In this implementation, the soldier 701*a* may use the microphone 705*a* for communication, e.g., for radio communication. In some examples, the control system 625 may be capable of receiving voice data via the microphone 705*a*, of determining a current position of the augmented hearing system 700 and of transmitting, via the interface system, a representation of the voice data and an indication of the current position of the augmented hearing system 700. In some implementations, the control system 625 may determine the current position of the augmented hearing system 700 according to data from the orientation system 620. Alternatively, or additionally, the control system 625 may determine the current position of the augmented hearing system 700 according to location data received via the interface system 605, e.g., via a GPS receiver.

In this example, the augmented hearing system 700 includes an array of other microphones, including microphones 705*a*-705*f*. The array of microphones may include other microphones that are not shown in FIG. 7, such as rear-mounted microphones. In some such examples, the augmented hearing system 700 may be capable of determining a location of one or more sound sources, or at least of a direction from which sound is emanating from a sound source, based at least in part on audio signals from the array of microphones. In some such examples, the sound sources may correspond with environmental elements such as gun shots, explosions, vehicle sounds, etc.

According to some examples, the array of microphones may include directional microphones. In some such examples, the augmented hearing system 700 may be capable of determining a direction from which sound is emanating from a sound source, based at least in part on the relative amplitudes of audio signals from the array of directional microphones.

However, in some implementations, the augmented hearing system 700 may be capable of determining a direction from which sound is emanating from a sound source, based at least in part on the difference in arrival times indicated by the audio signals from the array of microphones. According to some such implementations, a signal from each microphone of an array of microphones may be analyzed. For at least one subset of microphone signals, a time difference may be estimated, which may characterize the relative time delays between the signals in the subset. A direction may be estimated from which microphone inputs arrive from one or more acoustic sources, based at least partially on the estimated time differences. The microphone signals may be filtered in relation to at least one filter transfer function, related to one or more filters. A first filter transfer function component may have a value related to a first spatial orientation of the arrival direction, and a second component may have a value related to a spatial orientation that may be substantially orthogonal in relation to the first. A third filter function may have a fixed value. A driving signal for at least two loudspeakers may be computed based on the filtering.

Estimating an arrival may include determining a primary direction for an arrival vector related to the arrival direction based on the time delay differences between each of the microphone signals. The primary direction of the arrival vector may relate to the first spatial and second spatial orientations. The filter transfer function may relate to an impulse response related to the one or more filters. Filtering the microphone signals or computing the speaker driving signal may include modifying the filter transfer function of one or more of the filters based on the direction signals and mapping the microphone inputs to one or more of the loudspeaker driving signals based on the modified filter transfer function. The first direction signals may relate to a source that has an essentially front-back direction in relation to the microphones. The second direction signals may relate to a source that has an essentially left-right direction in relation to the microphones.

Filtering the microphone signals or computing the speaker driving signal may include summing the output of a first filter that may have a fixed transfer function value with the output of a second filter, which may have a transfer function that may be modified in relation to the front-back direction. The second filter output may be weighted by the front-back direction signal. Filtering the microphone signals or computing the speaker driving signal may further include summing the output of the first filter with the output of a third filter, which may have a transfer function that may be modified in relation to the left-right direction. The third filter output may be weighted by the left-right direction signal.

Some implementations of the augmented hearing system 700 may include a display system. In some such examples, the control system 625 may be capable of controlling the display system to display at least one of a personnel location or an environmental element location. In the example shown in FIG. 7, the augmented hearing system 700 includes eyewear 715. According to some examples, the eyewear 715 may include display capabilities. According to such examples, the eyewear 715 may include part of a display system of the augmented hearing system 700. In some such examples, the control system 625 may be capable of providing spatialization indications of personnel locations and/or of environmental element locations on the eyewear 715.

In this example, the augmented hearing system 700 includes a mobile device 720. The mobile device 720 may, in some implementations, have an Android operating system or an Apple operating system. The mobile device 720 may, for example, be capable of executing software applications for performing, at least in part, at least some of the methods disclosed herein. In some implementations, the control system 625 may include the control system of the mobile device 720. According to some implementations, a display of the mobile device may be controlled to display at personnel locations and/or environmental element locations. In some examples, the mobile device 720 may include at least part of an interface system, such as the interface system 605 that is described above with reference to FIG. 6. Accordingly, the mobile device 720 may, in some implementations, be used for communication. In some examples, user input features of the mobile device 720 may provide a portion of the user interface system of the augmented hearing system 700.

In some implementations, the headset 610 may provide at least some degree of ear protection functionality, which may include noise-dampening material in the headset 610. In some examples, the headset 610 may be capable of providing noise cancellation functionality. According to some such implementations, the headset 610 may be capable of adaptively attenuating environmental noise. In some such implementations, the headset 610 may be capable of adaptively attenuating environmental noise based, at least in part, on microphone data from the microphone system 630.

In some examples, the augmented hearing system 700 may be capable of providing audio according to a personalized hearing profile of a user. The personalized hearing profile data may include a model of hearing loss. According to some implementations, such a model may be an audiogram of a particular individual, based on a hearing examination. Alternatively, or additionally, the hearing loss model may be a statistical model based on empirical hearing loss data for many individuals. In some examples, the personalized hearing profile data may include a function that may be used to calculate loudness (e.g., per frequency band) based on excitation level. According to some such examples, the control system 625 may be capable of determining personalized hearing profile data for a particular user, e.g., by searching for the personalized hearing profile data in a memory of the augmented hearing system 700. In some such examples, the control system 625 may be capable of obtaining the personalized hearing profile data and of controlling the speaker system 615 of the headset 610 based, at least in part, on the personalized hearing profile data.

Figure 8:
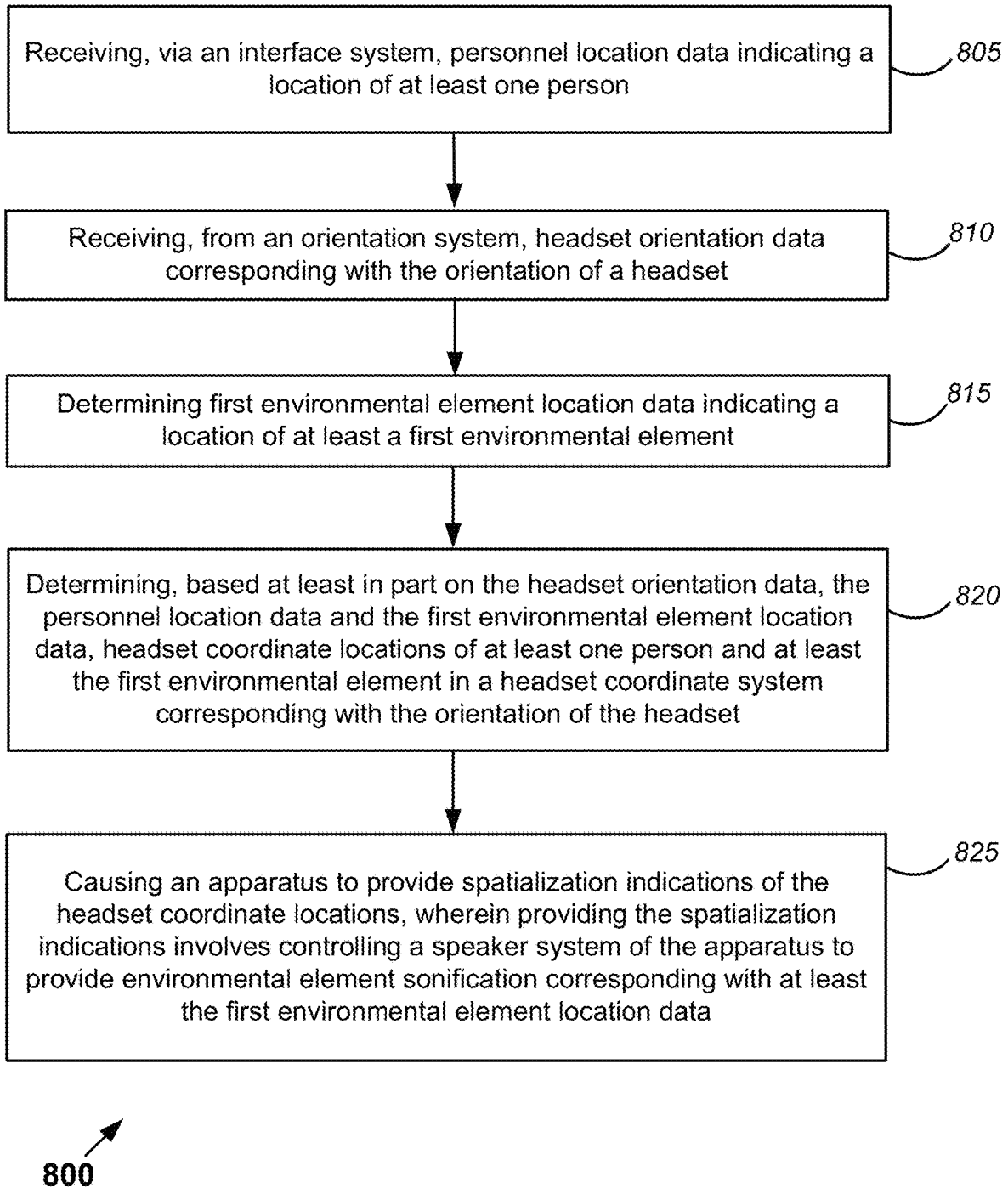
FIG. 8 is a flow diagram that outlines one example of a method that may be performed by the apparatus of FIG. 6 and/or FIG. 7.

FIG. 8 is a flow diagram that outlines one example of a method that may be performed by the apparatus of FIG. 6 and/or FIG. 7. The blocks of method 800, like other methods described herein, are not necessarily performed in the order indicated. Moreover, such methods may include more or fewer blocks than shown and/or described.

In this implementation, block 805 involves receiving, via an interface system, personnel location data indicating a location of at least one person. The interface system may include features such as those of the interface system 605, described above. According to some examples, the personnel location data may be included with one or more communications from at least one person, such as one or more squad members. For example, the personnel location data may include geographically-tagged metadata included with communication data received from the at least one person. The communication data may include voice data, which may in some examples include radio communication data transmitted via radio frequency. In some examples, the personnel location data may include coordinates in a cartographic coordinate system. For example, the personnel location data may include x, y and z coordinates, polar coordinates or cylindrical coordinates of a cartographic coordinate system. The coordinates of the personnel location data may, for example, correspond to projections onto a surface (e.g., a conic, cylindrical or planar surface) from a reference ellipsoid of the World Geodetic System.

In the example shown in FIG. 8, block 810 involves receiving, from an orientation system, headset orientation data corresponding with the orientation of a headset. The headset orientation data may differ according to the particular implementation and may depend, at least in part, on the capabilities of the orientation system. For example, in some implementations block 810 may involve receiving (e.g., by a control system such as the control system 625) raw gyroscope, accelerometer and/or magnetometer data from an orientation system (such as the orientation system 620). The control system may be capable of determining the orientation of the headset by processing the gyroscope, accelerometer and/or magnetometer data. However, in other implementations block 810 may involve receiving headset orientation data that has been processed by the orientation system and that more directly indicates the orientation of the headset.

In this implementation, block 815 involves determining first environmental element location data indicating a location of at least a first environmental element. According to some implementations, block 815 may involve determining first environmental element direction data indicating a direction of at least one first environmental element. In some examples, the first environmental element may be a stationary environmental element, such as a geographic feature, a compass direction, etc. In some examples, the first environmental element location data may include coordinates in a cartographic coordinate system. According to some implementations, block 815 may involve determining the first environmental element location data by reference to environmental element location data stored in a memory system of an augmented hearing system, e.g., by retrieving the environmental element location data from the memory system. Alternatively, or additionally, block 815 may involve determining the first environmental element location data by receiving environmental element location data from another device (such as a server, a device of a squad member, etc.) via an interface system.

Various implementations of method 800 may involve determining headset coordinate locations in a headset coordinate system corresponding with the orientation of the headset. In the example shown in FIG. 8, block 820 involves determining, based at least in part on the headset orientation data, the personnel location data and the first environmental element location data, headset coordinate locations of at least one person and at least the first environmental element in a headset coordinate system corresponding with the orientation of the headset.

Figure 9A:
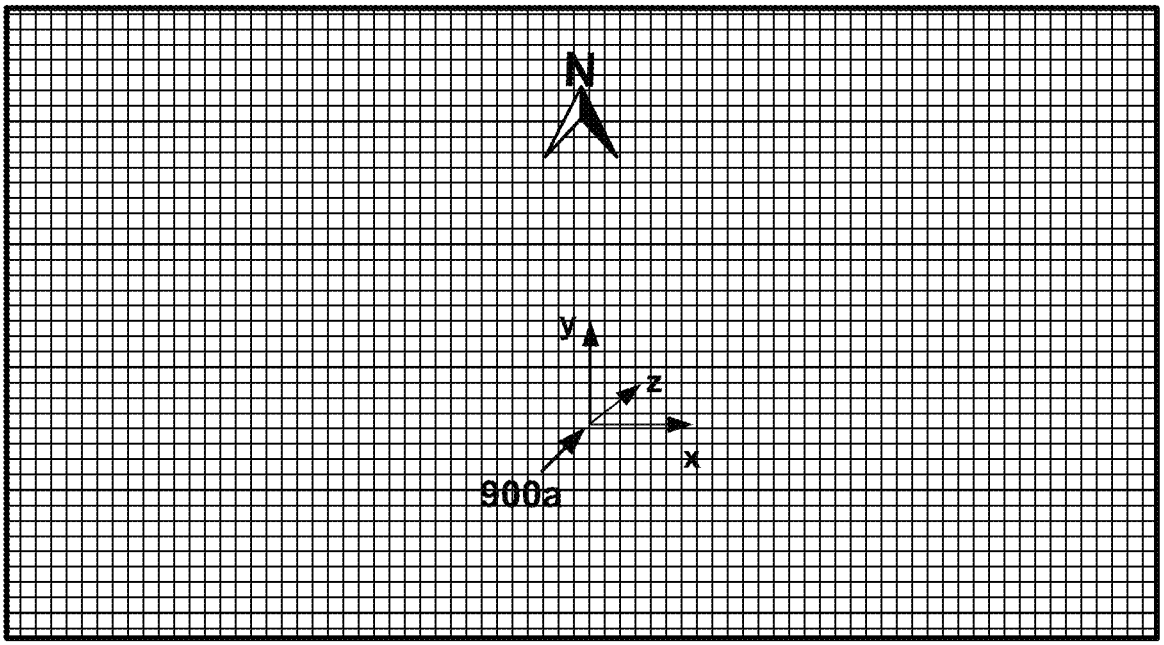
FIGS. 9A and 9B provide examples of coordinates in a cartographic coordinate system and coordinates in a headset coordinate system, respectively.
Figure 9B:
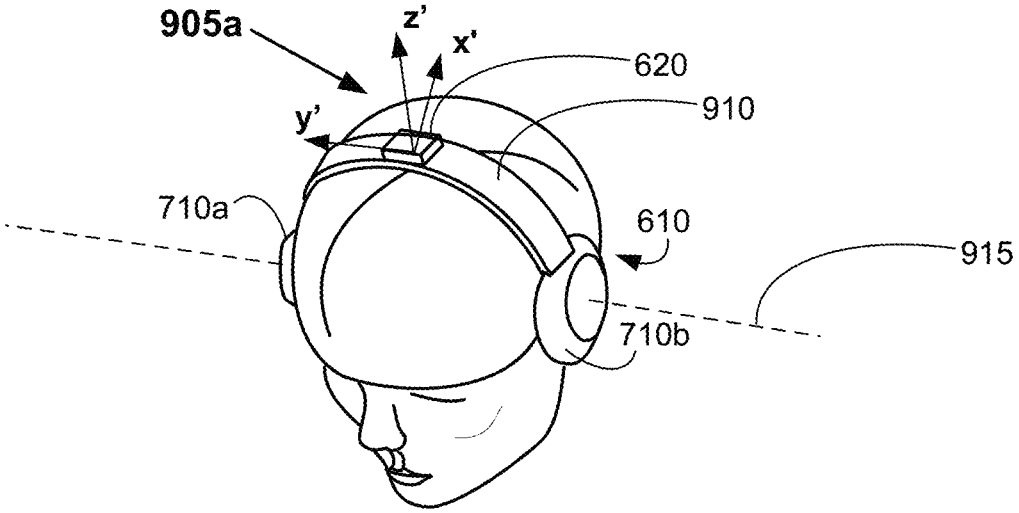

FIGS. 9A and 9B provide examples of coordinates in a cartographic coordinate system and coordinates in a headset coordinate system, respectively. FIG. 9A shows a map view that includes the cartographic coordinate system 900*a*. In this example, the cartographic coordinate system 900*a* is an x, y, z coordinate system. Here, the y axis of the cartographic coordinate system 900*a* is aligned in a north-south orientation, with the positive y axis pointing towards geographic north. In this example, the x axis of the cartographic coordinate system 900*a* is aligned in an east-west orientation, with the positive x axis pointing towards geographic east. Here, the z axis of the cartographic coordinate system 900*a* is aligned vertically, with the positive z axis pointing upwards.

FIG. 9B shows an example of a headset coordinate system 905*a*. In this example, the headset coordinate system 905*a* is an x, y, z coordinate system. Here, the y' axis of the headset coordinate system 905*a* is aligned with the headband 910 and is parallel to axis 915 between the headphone units 710*a* and 710*b*. Here, the z' axis of the headset coordinate system 905*a* is aligned vertically, relative to the top of the headband 910 and the top of the orientation system 620.

Although the orientation of the cartographic coordinate system 900*a* does not change, in this example the orientation of the headset coordinate system 905*a* changes according to changes in orientation of the headset 610. Accordingly, various implementations disclosed herein may involve transforming location data from coordinates of a cartographic coordinate system to a coordinates of a headset coordinate system. Some examples are described below with reference to FIG. 11.

Referring again to FIG. 8, block 825 involves causing the apparatus to provide spatialization indications of the headset coordinate locations. In this example, block 825 involves controlling the speaker system to provide environmental element sonification corresponding with at least the first environmental element location data. In some examples, causing the apparatus to provide spatialization indications may involve controlling the speaker system to provide personnel sonification corresponding with the personnel location data of at least one person.

As used herein, "sonification" may involve a characteristic sound, which may be repeated at a predetermined time interval. In some examples, the sonification for each environmental element, each person, etc., may be different from the sonification for other environmental elements, people, etc. For example, the sonification for each environmental element, each person, etc., may have a different pitch and/or may be presented at a different time interval.

In some examples, causing the augmented hearing system 700 to provide spatialization indications of an environmental element may involve rendering a sound corresponding with the environmental element to a location in a virtual acoustic space that corresponds with the headset coordinate location of the environmental element. Similarly, causing the augmented hearing system 700 to provide spatialization indications of a person may involve rendering a sound corresponding with the person to a location in the virtual acoustic space that corresponds with the headset coordinate location of the person. Locations in the virtual acoustic space may, in some examples, be determined with reference to a position of a virtual listener's head. The position of the virtual listener's head may be determined, or at least inferred, by a position of the headset 610. In some such examples, an origin of the headset coordinate system may correspond with a point inside the virtual listener's head.

Figure 10:
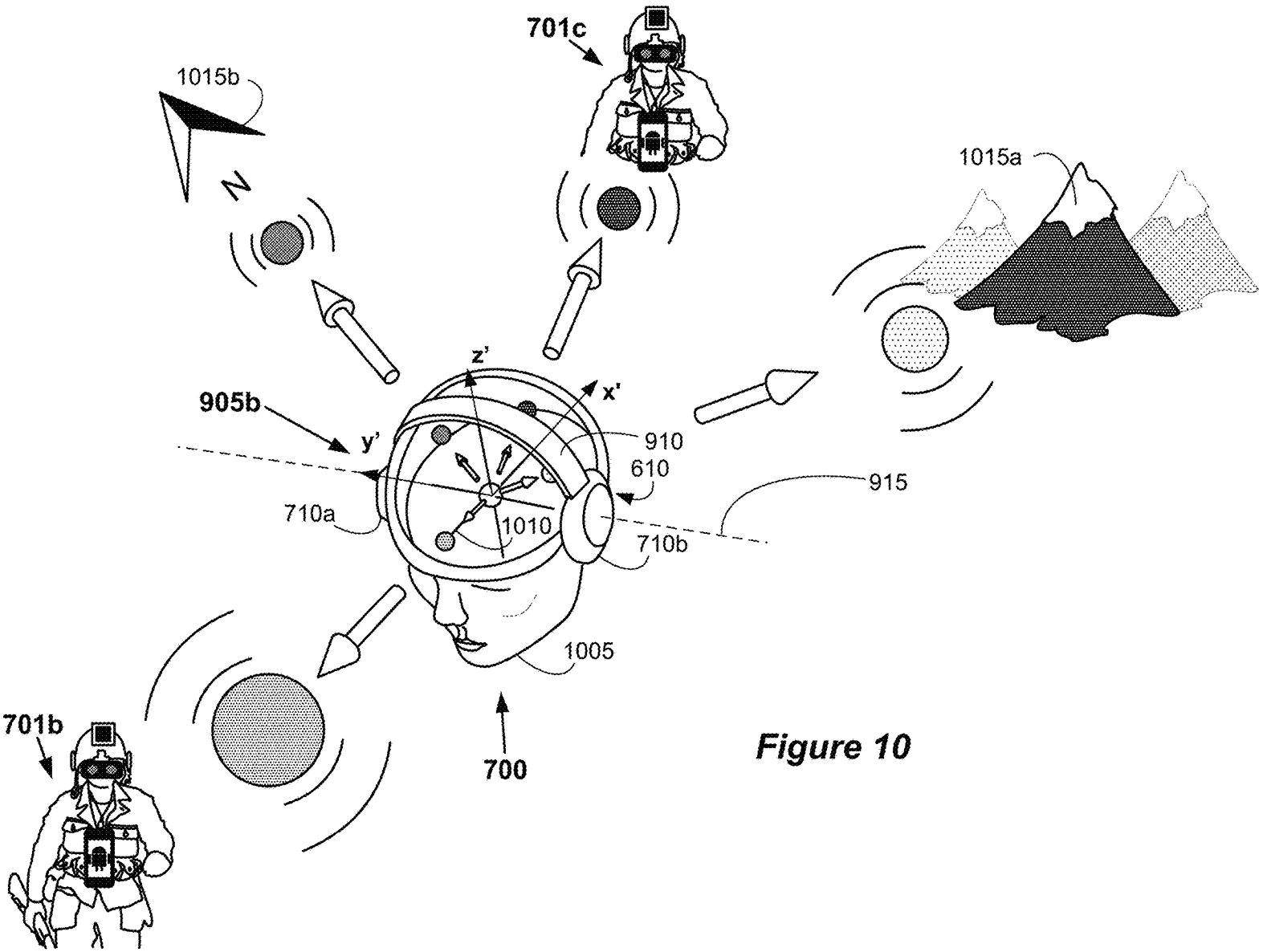
FIG. 10 shows examples of an augmented hearing system providing personnel sonification and environmental element sonification.

FIG. 10 shows examples of an augmented hearing system providing personnel sonification and environmental element sonification. In the example shown in FIG. 10, only the headset 610 of the augmented hearing system 700 is shown. In this implementation, the sonification is being provided with reference to a headset coordinate system 905*b*. In this example, the headset coordinate system 905*b* is an x, y, z coordinate system. Here, the y' axis of the headset coordinate system 905*b* is oriented along the axis 915 between the headphone units 710*a* and 710*b*. Here, the z' axis of the headset coordinate system 905*b* is aligned vertically, through the headband 910, and the x' axis of the headset coordinate system 905*b* extends along an axis 1010 that extends from the front of the headset 610 to the back of the headset 610. In this example, the x' axis of the headset coordinate system 905*b* extends from behind the soldier's head 1005 to the front of the soldier's head 1005.

Here, the augmented hearing system 700 is providing environmental element sonification, via a speaker system of the headset 610 that corresponds with a location of an environmental element 1015*a*, which is a mountain in this example.

In this example, the augmented hearing system 700 is providing environmental element sonification that corresponds with a direction of an environmental element 1015*b*, which is the direction of geographic north in this example. Moreover, in the example shown in FIG. 10, the augmented hearing system 700 is providing personnel sonification corresponding with the personnel location data of soldiers 701*b* and 701*c*, both of which are squad members in this example.

As noted above, in some implementations a control system of the augmented hearing system 700 may be capable of determining, based at least in part on microphone data from the microphone system, second environmental element location data indicating a location of another type of environmental element, which may sometimes be referred to herein as a second environmental element. In some instances, the second environmental element may be a moveable environmental element, such as a projectile (e.g., a bullet or missile), an aircraft, a vehicle, etc. In some instances, the second environmental element may be an explosion.

According to some such implementations, the control system may be capable of determining, based at least in part on the headset orientation data and the second environmental element location data, a headset coordinate location of the second environmental element. As noted elsewhere herein, the headset coordinate location may be relative to the orientation of the headset 610, e.g., relative to a headset coordinate system. In some examples, the control system may be capable of causing an apparatus to provide a spatialization indication of the headset coordinate location of the second environmental element. In some such examples, the spatialization indication may be an environmental element sonification. Alternatively, or additionally, the spatialization indication may be a presentation of the location of the second environmental element on a display.

In some implementations, a control system of the augmented hearing system 700 may be capable of determining, based at least in part on microphone data from the microphone system, second environmental element trajectory data indicating a trajectory of a second environmental element. For example, the second environmental element trajectory data may indicate the trajectory of a bullet, a missile, an aircraft, etc. In some examples, the control system may be capable of determining, based at least in part on the headset orientation data and the second environmental element trajectory data, a headset coordinate trajectory of the second environmental element that is relative to the orientation of the headset. The control system may be capable of causing an apparatus of the augmented hearing system 700 to provide a spatialization indication of the headset coordinate trajectory of the second environmental element. In some such examples, the spatialization indication may be an environmental element trajectory sonification. Alternatively, or additionally, the spatialization indication may be a presentation of the trajectory of the second environmental element on a display.

Figure 11:
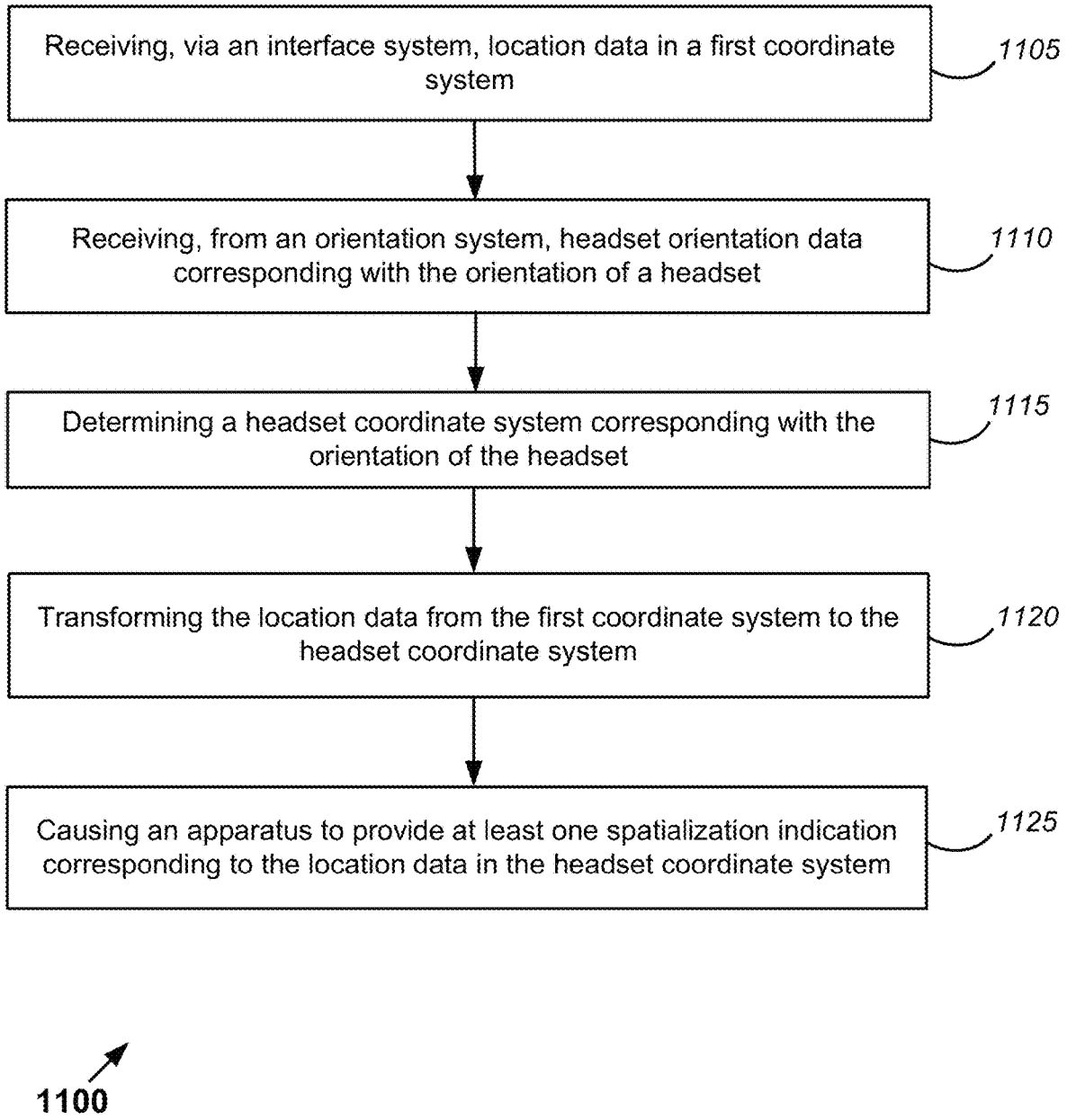
FIG. 11 is a flow diagram that shows example blocks of another method.

FIG. 11 is a flow diagram that shows example blocks of another method. In this example, block 1105 involves receiving, via an interface system, location data in a first coordinate system. The first coordinate system may, for example, be a cartographic coordinate system. In some implementations, block 1105 may involve receiving communication data, such as radio communication data, that includes the location data. In some such implementations, the location data may be geographically-tagged metadata included with communication data, such as radio communication data, that is received from a communications device used by another person (such as a squad member).

In this example, block 1110 involves receiving, from an orientation system, headset orientation data corresponding with the orientation of a headset. As described above, the headset orientation data may be in various forms according to the particular implementation, depending in part on the capabilities of the orientation system. Here, block 1115 involves determining a headset coordinate system corresponding with the orientation of the headset. The headset coordinate system may, for example, be the headset coordinate system 905*a* or the headset coordinate system 905*b* described above. Alternatively, the headset coordinate system may be a different the headset coordinate system, such as a polar coordinate system.

In this implementation, block 1120 involves transforming the location data from the first coordinate system to the headset coordinate system. According to some examples, block 1120 may involve applying (e.g., by a control system such as the control system 625) a rotation matrix to the location data in the first coordinate system in order to determine the corresponding coordinates in the headset coordinate system.

In this example, block 1125 involves causing an apparatus to provide at least one spatialization indication corresponding to the location data in the headset coordinate system. For example, block 1125 may involve causing (e.g., by a control system such as the control system 625) a speaker system to provide one or more spatialization indications via sonification and/or causing a display to provide one or more spatialization indications by displaying the location data on the display.

Various modifications to the implementations described in this disclosure may be readily apparent to those having ordinary skill in the art. The general principles defined herein may be applied to other implementations without departing from the scope of this disclosure. Thus, the claims are not intended to be limited to the implementations shown herein, but are to be accorded the widest scope consistent with this disclosure, the principles and the novel features disclosed herein.

The invention claimed is:

1. An apparatus, comprising:
an interface system;
a headset including:
a speaker system;
a microphone system; and
an orientation system capable of determining an orientation of the headset; and
a control system capable of:
receiving, from the orientation system, headset orientation data corresponding with the orientation of the headset;
determining first environmental element location data indicating one or more locations of at least a first environmental element;
determining, based at least in part on the headset orientation data and the first environmental element location data, one or more headset coordinate locations of the first environmental element in a headset coordinate system corresponding with the orientation of the headset;
determining, based at least in part on microphone data from the microphone system, first environmental element trajectory data indicating a trajectory of the first environmental element;
determining, based at least in part on the headset orientation data and the first environmental element trajectory data, a headset coordinate trajectory of the first environmental element that is relative to the orientation of the headset; and
causing the apparatus to provide one or more spatialization indications of the one or more headset coordinate locations and a spatialization indication of the headset coordinate trajectory of the first environmental element.

2. The apparatus of claim 1, wherein the control system is further capable of:
receiving, via the interface system, personnel location data indicating a location of at least one person;
determining, based at least in part on the headset orientation data and the personnel location data, a headset coordinate location of the at least one person; and
causing the apparatus to provide a spatialization indication of the headset coordinate location of the at least one person.

3. The apparatus of claim 2, further comprising a display system, wherein causing the apparatus to provide spatialization indications involves controlling the display system to display at least one of a personnel location an environmental element location or an environmental element trajectory.

4. The apparatus of claim 3, wherein the display system includes a display presented on eyewear and wherein the control system is capable of controlling the display system to providing a spatialization indication of at least one of the personnel location the environmental element location or the environmental element trajectory on the eyewear.

5. The apparatus of claim 2, wherein the personnel location data comprises geographically-tagged metadata included with received radio communication data.

6. The apparatus of claim 2, wherein the control system is further capable of:
determining second environmental element location data indicating a location of a second environmental element;
determining, based at least in part on the headset orientation data and the second environmental element location data, a headset coordinate location of the second environmental element that is relative to the orientation of the headset; and
causing the apparatus to provide a spatialization indication of the headset coordinate location of the second environmental element.

7. The apparatus of claim 6, wherein determining the second environmental element location data is based, at least in part, on microphone data from the microphone system.

8. The apparatus of claim 1, wherein the control system is further capable of:
receiving voice data via the microphone system;
determining a current position of the apparatus; and
transmitting, via the interface system, a representation of the voice data and an indication of the current position of the apparatus.

9. The apparatus of claim 1, wherein the headset includes apparatus for adaptively attenuating environmental noise based, at least in part, on the microphone data.

10. The apparatus of claim 1, wherein the control system is further capable of:

determining personalized hearing profile data; and controlling the speaker system based, at least in part, on the personalized hearing profile data.

11. The apparatus of claim 1, wherein the orientation system includes at least one device selected from a list of devices consisting of an accelerometer, a magnetometer and a gyroscope.

12. The apparatus of claim 1, wherein causing the apparatus to provide spatialization indications involves rendering at least one sound in a virtual acoustic space.

13. The apparatus of claim 12, wherein locations in the virtual acoustic space are determined with reference to a position of a virtual listener's head.

14. The apparatus of claim 13, wherein an origin of the headset coordinate system corresponds with a point inside the virtual listener's head.

15. The apparatus of claim 1, wherein the control system is capable of transforming location data from a first coordinate system to the headset coordinate system.

16. The apparatus of claim 15, wherein the first coordinate system is a cartographic coordinate system.

17. A method, comprising:

receiving, from a headset orientation system, headset orientation data corresponding with an orientation of a headset;

determining first environmental element location data indicating one or more locations of at least a first environmental element;

determining, based at least in part on the headset orientation data and the first environmental element location data, one or more headset coordinate locations of the first environmental element in a headset coordinate system corresponding with the orientation of the headset;

determining, based at least in part on microphone data from the microphone system, first environmental element trajectory data indicating a trajectory of the first environmental element;

determining, based at least in part on the headset orientation data and the first environmental element trajectory data, a headset coordinate trajectory of the first environmental element that is relative to the orientation of the headset; and causing an apparatus to provide one or more spatialization indications of the one or more headset coordinate locations and a spatialization indication of the headset coordinate trajectory of the first environmental element.

18. The method of claim 17, further comprising:

receiving, via the interface system, personnel location data indicating a location of at least one person;

determining, based at least in part on the headset orientation data and the personnel location data, a headset coordinate location of the at least one person; and causing the apparatus to provide a spatialization indication of the headset coordinate location of the at least one person.

19. A non-transitory medium having software stored thereon, the software including instructions for controlling at least one device for:

receiving, from a headset orientation system, headset orientation data corresponding with an orientation of a headset;

determining first environmental element location data indicating one or more locations of at least a first environmental element;

determining, based at least in part on the headset orientation data and the first environmental element location data, one or more headset coordinate locations of the first environmental element in a headset coordinate system corresponding with the orientation of the headset;

determining, based at least in part on microphone data from the microphone system, first environmental element trajectory data indicating a trajectory of the first environmental element;

determining, based at least in part on the headset orientation data and the first environmental element trajectory data, a headset coordinate trajectory of the first environmental element that is relative to the orientation of the headset; and causing an apparatus to provide one or more spatialization indications of the one or more headset coordinate locations and a spatialization indication of the headset coordinate trajectory of the first environmental element.

20. The non-transitory medium of claim 19, wherein the the software includes instructions for controlling the at least one device for:

receiving, via the interface system, personnel location data indicating a location of at least one person;

determining, based at least in part on the headset orientation data and the personnel location data, a headset coordinate location of the at least one person; and causing the apparatus to provide a spatialization indication of the headset coordinate location of the at least one person.

* * * * *